United States Patent [19]

Nakamura et al.

[11] Patent Number: 5,000,015

[45] Date of Patent: Mar. 19, 1991

[54] WASHING AND DEHYDRATING MACHINE

[75] Inventors: Fumio Nakamura, Toyokawa; Masayoshi Shimano, Okazaki; Masayuki Arakawa, Nagoya, all of Japan

[73] Assignee: Brother Kogyo Kabushiki Kaisha, Aichi, Japan

[21] Appl. No.: 455,286

[22] Filed: Dec. 22, 1989

[30] Foreign Application Priority Data

| | | | |
|---|---|---|---|
| Dec. 22, 1988 | [JP] | Japan | 63-325442 |
| Mar. 29, 1989 | [JP] | Japan | 1-79290 |
| Apr. 6, 1989 | [JP] | Japan | 1-89147 |
| Jun. 14, 1989 | [JP] | Japan | 1-152760 |
| Jul. 10, 1989 | [JP] | Japan | 1-178532 |
| Aug. 17, 1989 | [JP] | Japan | 1-211923 |

[51] Int. Cl.[5] ..... D06F 23/00; D06F 37/20; D06F 37/36

[52] U.S. Cl. ..... 68/23.3; 68/25; 68/139; 68/140

[58] Field of Search ..... 68/16, 23 R, 23.3, 25, 68/139, 140

[56] References Cited

U.S. PATENT DOCUMENTS

| | | | |
|---|---|---|---|
| 2,142,995 | 1/1939 | Busi | 68/25 |
| 2,171,499 | 8/1939 | Mario Busi | 68/25 |
| 2,283,612 | 5/1942 | Perry | 68/20 |
| 2,559,708 | 7/1951 | Calhoun | 68/25 |
| 2,748,496 | 6/1956 | Hellyer | 68/139 X |
| 3,005,328 | 10/1961 | Gehrig | 68/16 X |
| 4,114,406 | 9/1978 | Horowitz et al. | 68/24 |
| 4,782,544 | 11/1988 | Nystuen et al. | 68/23 R X |

FOREIGN PATENT DOCUMENTS

| | | | |
|---|---|---|---|
| 455418 | 2/1928 | Fed. Rep. of Germany | 68/25 |
| 1309094 | 10/1962 | France | 68/25 |
| 61-196993 | 9/1986 | Japan . | |

*Primary Examiner*—Philip R. Coe
*Attorney, Agent, or Firm*—Oliff & Berridge

[57] ABSTRACT

In the machine of this invention, a rotation-support member is provided in an outer tub for containing water so that the rotation-support member can rotate about a vertical axis. The rotation-support member supports a perforated inner tub rotatable about a horizontal axis. When the laundry is washed or rinsed, the laundry is loaded in the inner tub, water is supplied to the outer tub until the water reaches inside the inner tub, and the inner tub is rotated about the horizontal axis. When the washed or rinsed laundry is dehydrated, water is drained from the outer tub, the rotation-support member and the inner tub are rotated together about the vertical axis in the same direction at the same high speed. Consequently, the machine is simply constructed and inexpensively manufacture.

16 Claims, 32 Drawing Sheets

WASHING AND DEHYDRATING MACHINE

BACKGROUND OF THE INVENTION

This invention relates to a laundry machine that can wash and dehydrate laundry. During dehydrating, the machine removes water from the laundry, but leaves the laundry damp.

The following three types of such laundry machine are known.

The first type of the laundry machine comprises a water container, a perforated dehydrating tub supported in the water container for rotating about a vertical axis, and an agitator rotatably supported in the dehydrating tub. To wash and rinse the laundry, the laundry is loaded in the water container, water is supplied to the water container, and the agitator is rotated. Subsequently, water is drained from the water container, and the dehydrating tub is rotated at high speed to dehydrate the laundry.

The laundry machine of the second type comprises a water container and a perforated rotation drum. The rotation drum is supported in the water container so that the drum can rotate about a horizontal axis. After the laundry is loaded in the rotation drum and water is supplied to the water container, the rotation drum is rotated to wash and rinse the laundry. Subsequently, water is drained and the rotation drum rotates at high speed to dehydrate the laundry.

U.S. Pat. No. 2,171,499 proposes the third type of the laundry machine which comprises a water tub, a ring supported in the water container for rotating about a vertical axis, a perforated spherical container supported in the ring for rotating about a horizontal axis, a drive means for rotating the spherical container and the ring, and a change means for controlling the drive means and for choosing one between the horizontal and the vertical rotations of the spherical container and the ring. After the laundry is loaded in the spherical container and water is supplied to the water tub, only the container rotates about the horizontal axis to wash the laundry. Subsequently, in order to dehydrate the laundry the water is drained and the ring and the container rotate about the vertical axis at high speed.

In the first washing machine, however, large amount of water is required for washing the laundry because the laundry is washed and rinsed by the water driven by the agitator. In addition, the laundry is entangled and the dehydrating tub loses its balance after washing operation. Therefore, the dehydrating tub is apt to abnormally rotate at the beginning of the dehydrating operation.

The second type of the laundry machine requires less water and has less entangled laundry than the first laundry machine. However, after the laundry is washed, the laundry accumulates in the bottom of the rotation drum. In the next dehydrating process, the rotation drum rotates about the horizontal axis at high speed, resulting in the following problem. Specifically, during the rotation the rotation drum loses its balance and vibrates due to the unbalanced load of the laundry, thus generating noise. Weights for preventing the noise makes the laundry machine heavier and manufacture cost becomes high.

The third type of the laundry machine has the following problem when the ring and the spherical container rotate about the vertical axis at high speed especially in the dehydrating operation. Specifically, the container, which is not fixed to or regulated by the ring, is allowed to rotate about the horizontal axis when rotating around the vertical axis at high speed. When the container with the laundry accumulated at its bottom rotates with the ring about the vertical axis at high speed for dehydrating the laundry after the washing operation, the laundry is pushed up to the horizontal axis due to the centrifugal force. Especially when the center of gravity of the laundry is beside the bottommost of the spherical container, the centrifugal force is generated in the direction of the center of gravity, thus inclining the container about 90° in the direction, when the container rotates with the ring in such condition about the vertical axis at high speed, it loses its balance, vibrates and generates noise. Consequently the laundry cannot be properly dehydrated in such a case.

SUMMARY OF THE INVENTION

One object of this invention is to provide a washing and dehydrating machine that requires a small quantity of water and has little entangled laundry in the washing operation and that can dehydrate the laundry without losing the center of balance of an inner tub and a rotary supporter in the dehydrating operation.

Another object of the invention is to provide a washing and dehydrating machine that can modify the unbalance of the laundry in the middle of the dehydrating operation so as to uniformly and effectively dehydrate the laundry.

Another object of the invention is to provide an inexpensive washing and dehydrating machine with simple structure that utilizes skew gears or the like as a means for rotating the inner tub so that the rotation of the inner tub is not transmitted to a motor.

Another object of the invention is to provide a washing and dehydrating machine with a heater for heating water to wash the laundry effectively.

Another object of the invention is to provide a washing and dehydrating machine in which water is supplied to the upper outer surface of the inner tub at the beginning of the dehydrating process after the washing operation so that bubbles in the inner tub is washed away.

Another object of the invention is to provide a washing and dehydrating machine in which position detecting means stops the rotation of the inner tub when an opening of an outer-tub cover and an opening of the inner tub coincide, thus the laundry being carried out through the openings without difficulty.

These objects are achieved by a washing and dehydrating machine which comprises an outer tub for containing water, a means for supplying water to and draining water from the outer tub, a rotary supporter rotatable about a vertical axis in the outer tub, and a perforated inner tub containing the laundry and being supported by the rotary supporter for rotating about a horizontal axis. The washing and dehydrating machine further comprises an inner-tub rotation means for rotating the inner tub, a rotation drive means for driving the inner-tub rotation means, and a rotary-supporter rotation means for driving the rotary supporter 26 connectable to or disconnectable from the rotation drive means. When the rotary-supporter rotation means is disconnected from the rotation drive means, the rotary-supporter rotation means allows the inner tub to rotate alone while the rotary supporter is stopped. When the rotary-supporter rotation means is connected to the rotation drive means, the rotary-supporter rotation means rotates both the rotary supporter and the inner tub about the vertical axis together in the same direction and at the same high speed.

In operation, water is supplied to the outer tub so that the water reaches the inside of the inner tub and the laundry is loaded in the inner tub. The rotary-supporter rotating means is then disconnected from the rotation drive means so that the inner tub rotates about the horizontal axis to wash and rinse the laundry. After the laundry is washed or rinsed, the outer tub is drained. The rotary-supporter rotation means is connected to the rotation drive means so that the rotary supporter and the inner tub rotate about the vertical axis altogether in the same direction and at the same high speed to dehydrate the laundry.

When the laundry is dehydrated, the rotary-supporter rotation means is connected to the rotation drive means and the rotation of the inner tub relative to the rotary supporter is controlled. Specifically, the inner tub does not rotate about the horizontal axis. The inner tub and the rotary supporter rotate together about the vertical axis at high speed. Consequently, even when the laundry is distributed unevenly about the vertical axis in the inner tub, the inner tub rotates stably at high speed without vibrating. Since the inner tub thus starts high-speed stable rotation without trouble, the laundry is distributed evenly about the vertical axis of the inner tub due to the centrifugal force of the inner tub. The laundry is thus appropriately dehydrated.

BRIEF DESCRIPTION OF THE DRAWINGS

FIG. 1 is a side cross-sectional view of first embodiment of the invention.

FIG. 2 is a partial cross-sectional view of members for supporting an outer tub.

FIG. 3 is partial front cross-sectional view of the first embodiment.

FIG. 4 is a partial perspective view of a bearing of a rotary supporter for the first embodiment.

FIG. 5 is a perspective view of an inner tub.

FIG. 6 is a partial cross-sectional view of the bearing of the rotary supporter engaged with a cylindrical member of the inner tub for the first embodiment.

FIG. 7 is a partial cross-sectional view of projections screwed in the inner tub for the first embodiment.

FIG. 8 is also a partial cross-sectional view of screwed projections in the inner tub.

FIG. 9 is a partial cross-sectional view of a drain mechanism in the side of the outer tub for the first embodiment FIG. 10 is a partial plan view of a warm air supply device of the first embodiment.

FIG. 11 is a partial front view of the first embodiment showing the warm air supply device.

FIG. 12 is a partial enlarged cross-sectional view of a part of a drive mechanism for the inner tub and the rotary supporter.

FIG. 13 is a block diagram for a control circuit of the first embodiment.

FIG. 14 is a time chart for processes of the first embodiment.

FIG. 15 is a flowchart for detecting that a lid of a housing and a lid of the inner tub are closed.

FIG. 16 is a flowchart for setting operation time according to detected load for the first embodiment.

FIG. 17 is a flowchart for stopping the inner tub at a predetermined position.

FIG. 18 is a flowchart for correcting the abnormal rotation of the rotary supporter when the laundry is dehydrated.

FIG. 19 is a flowchart for stopping the rotary supporter at a predetermined position.

FIG. 20 is a view of water supply operation to the inner tub and the rotary supporter.

FIG. 21 is a view of water supply operation through a water outlet to the outer surface of the inner tub. FIG. 22 is a time chart for processes of the second embodiment.

FIG. 23 is an illustration of the laundry accumulated in the inner tub in the dehydrating process.

FIG. 24 is an illustration of the laundry stirred after being accumulated.

FIG. 25 is a time chart for the dehydrating process.

FIG. 26 is a side cross-sectional view of the washing and dehydrating machine.

FIG. 27 is a partial enlarged cross-sectional view of the bottom of the machine.

FIG. 28 is a partial flat view of a water heating device of the fourth embodiment.

FIGS. 29 is an enlarged cross-sectional view of supporting members of the end of a heater.

FIG. 30 is a partial front cross-sectional view of the washing and dehydrating machine.

FIG. 31 is a perspective view of the inner tub when a lid is removed.

FIG. 32 is a partial enlarged cross-sectional view of the inner tub when the lid of the inner tub is closed and when it is opened.

FIG. 33 is a partial enlarged cross-sectional view of the lid of the inner tub inserted in a rectangular hole of the inner tub.

FIG. 34 is a partial enlarged cross-sectional view of a drive mechanism for the inner tub and the rotary supporter.

FIG. 35 is an enlarged front view of the skew gears.

DETAILED DESCRIPTION OF PREFERRED EMBODIMENTS

DESCRIPTION OF THE FIRST EMBODIMENT

The first embodiment of this invention is explained referring to FIGS. 1 through 19.

STRUCTURE OF A HOUSING FOR A FIRST EMBODIMENT

Figure 1:
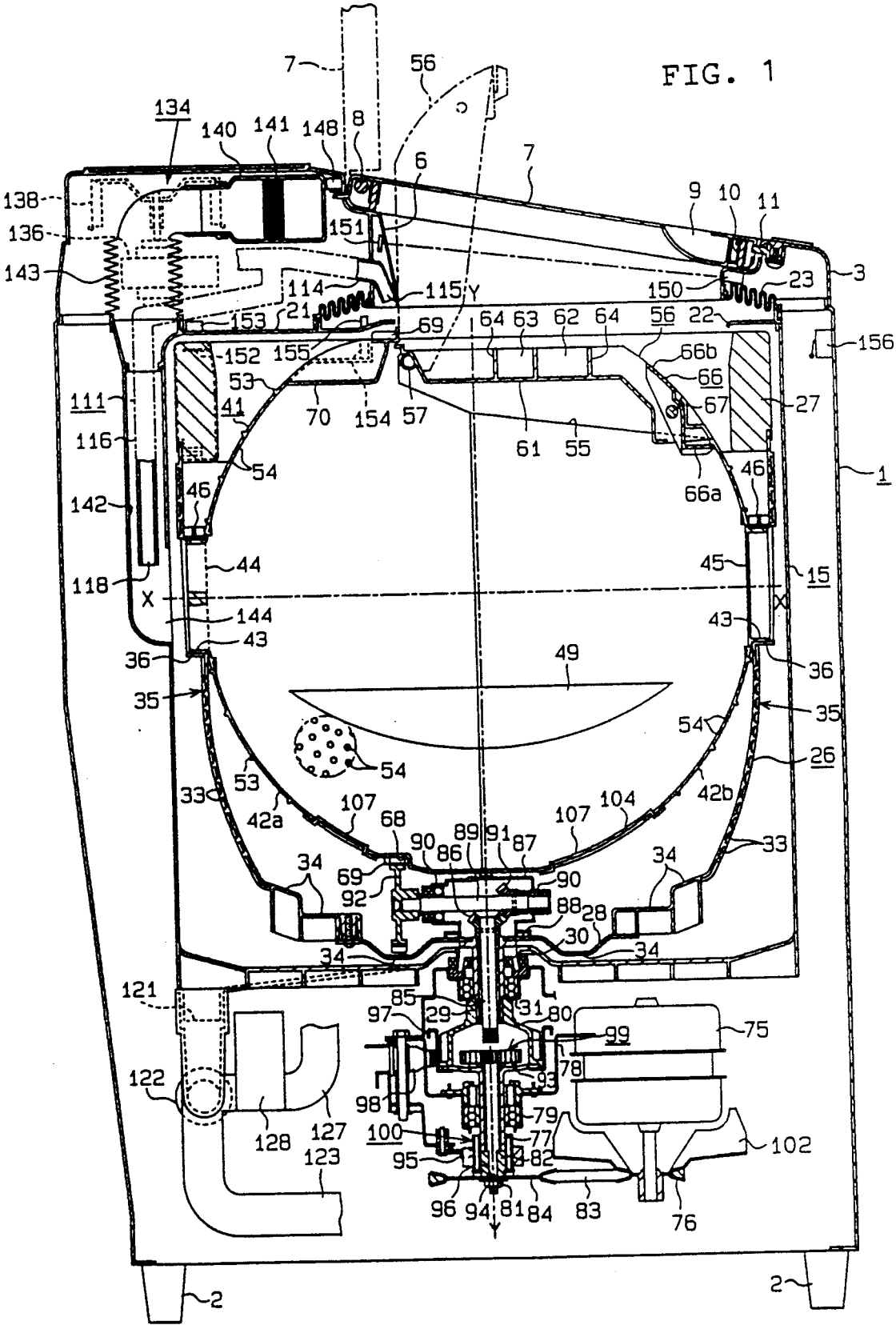
FIGS. 1 through 19 show a first embodiment of this invention.
Figure 3:
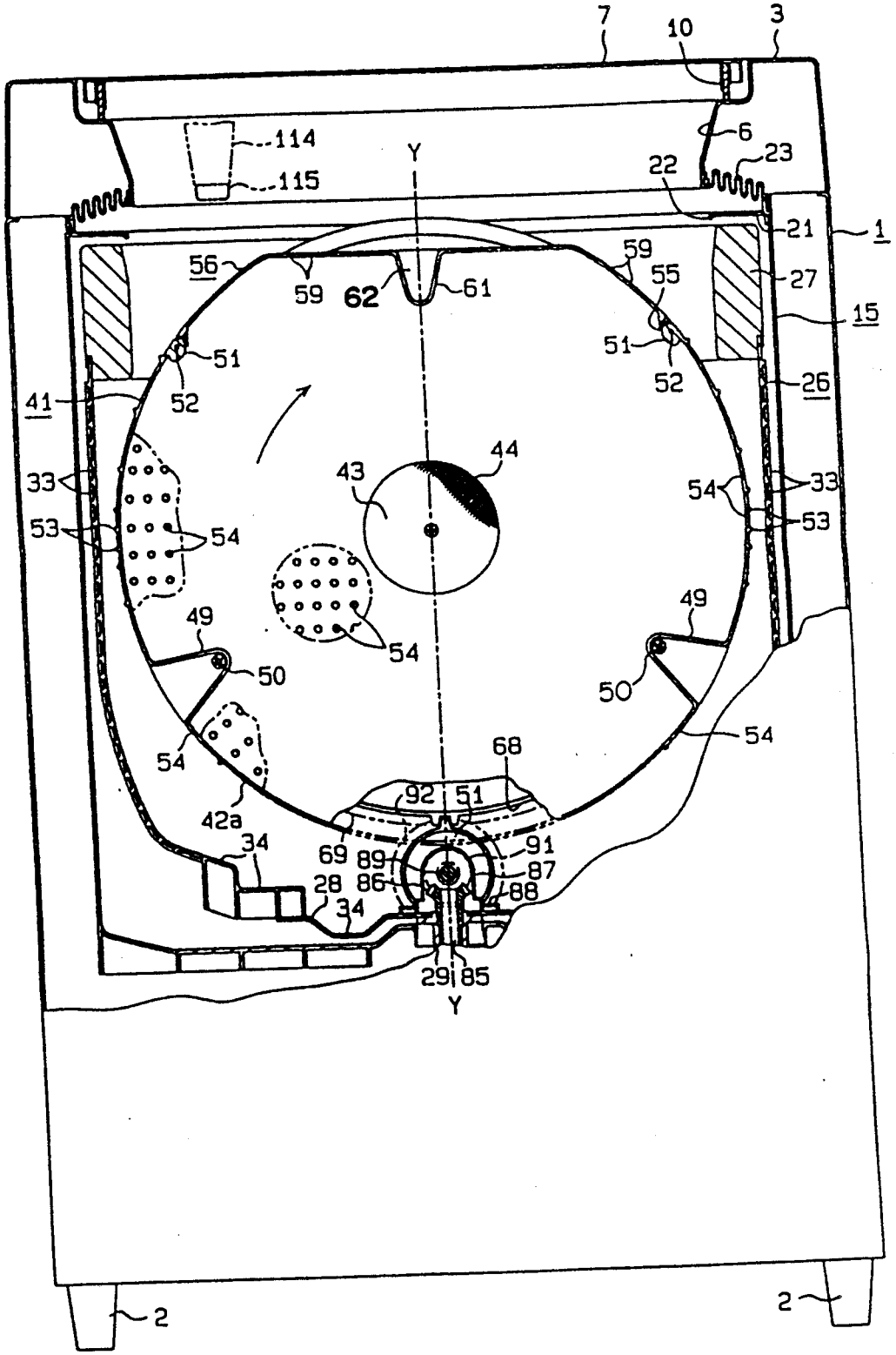
Figure 10:
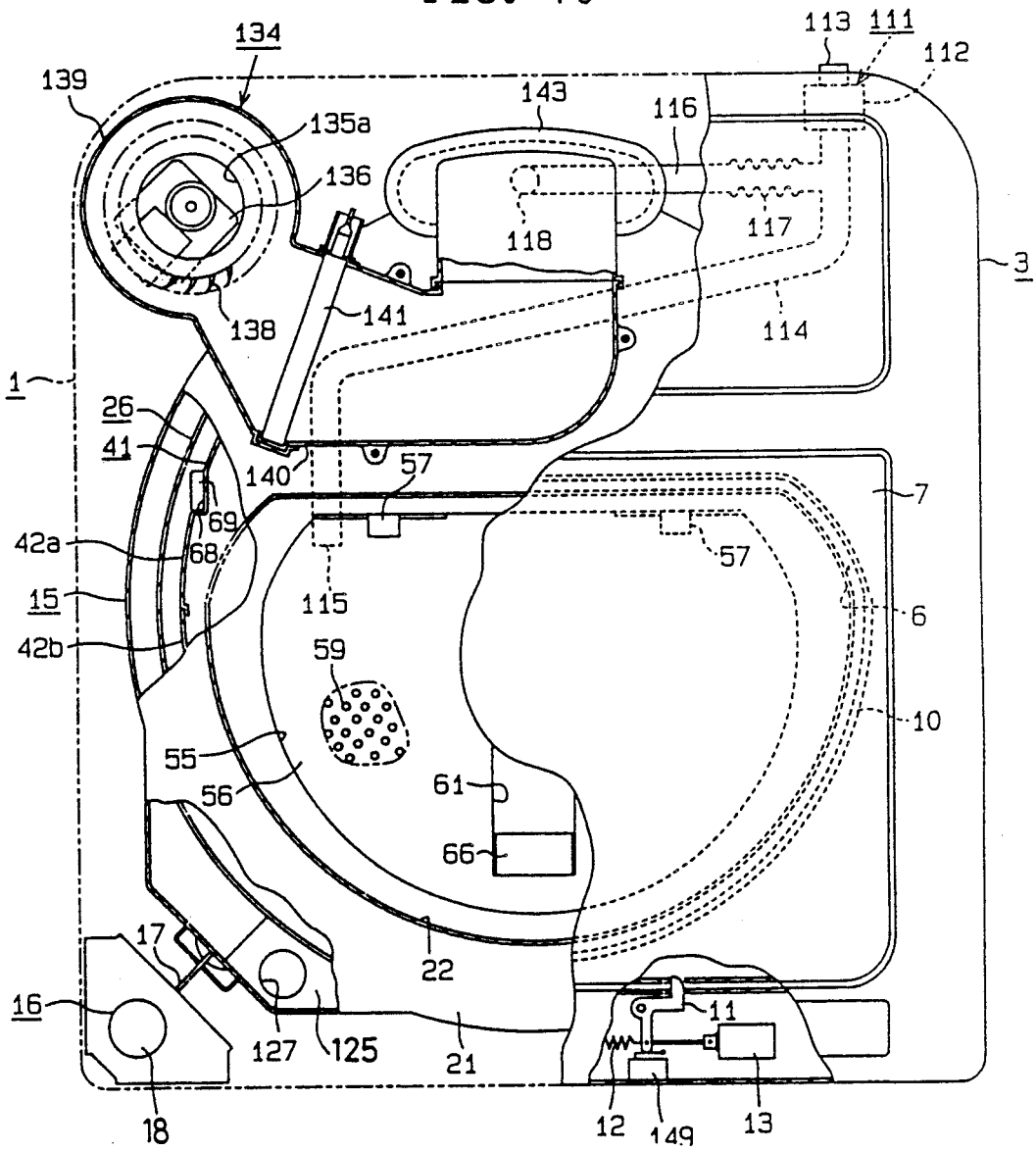

As shown in FIGS. 1, 3 and 10, a housing 1 is like a box of steel. The housing 1 has four feet 2 on its bottom and a cover 3 of synthetic resin on its top surface. An opening 6 is provided in a front top of the cover 3 through which the laundry is loaded or unloaded. A lid 7 of synthetic resin is rotatably supported on a support 8 to open or close the opening 6 in the cover 3, and has a handle 9 for opening the lid 7 on the front top of the lid 7. A packing 10 of elastic rubber-like material has almost the same shape as that of the opening 6 in the cover 3.

A locking lever 11 is rotatably attached in the cover 3. A spring 12 can detach the locking member 11 from the lid 7. A solenoid 13 provided in the cover 3 energizes the locking lever 11 to engage with the lid 7 to close.

STRUCTURE OF AN OUTER TUB FOR THE FIRST EMBODIMENT

Figure 2:
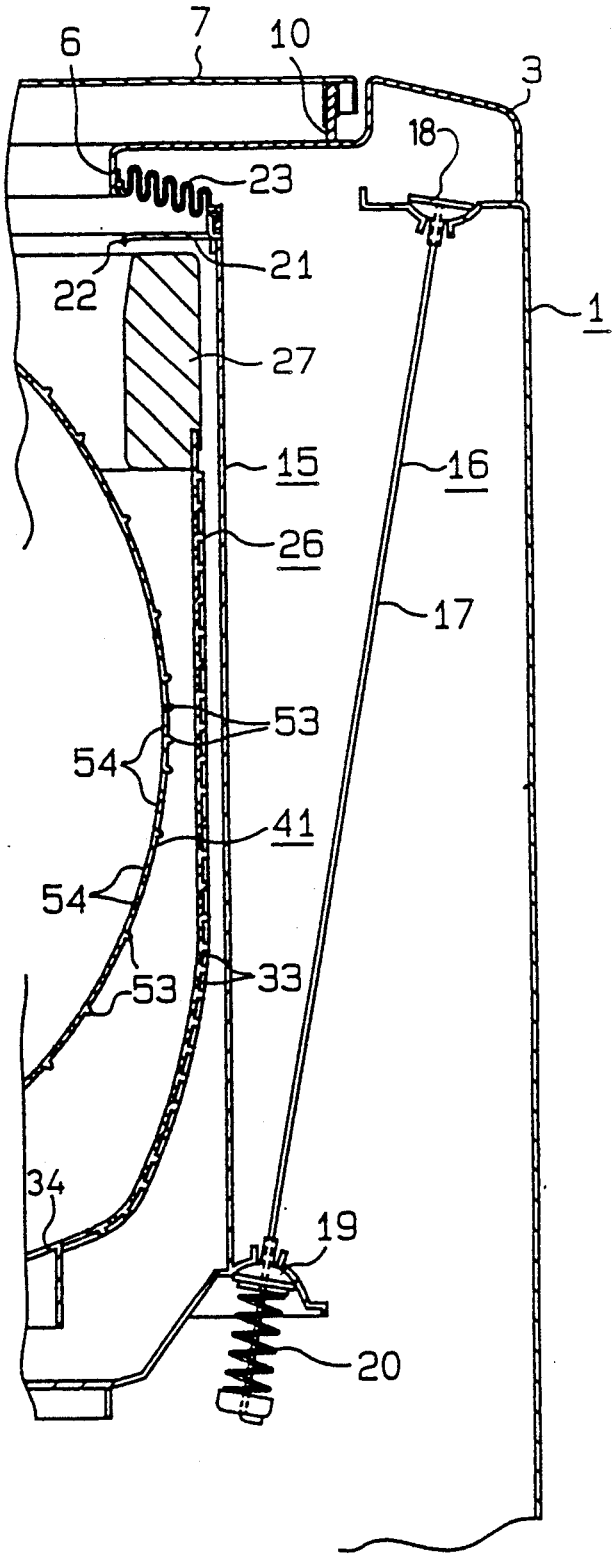

As shown in FIGS. 1 and 3, an outer tub 15 for containing water is formed in a cylinder having a bottom formed from synthetic resin. Four suspenders 16 suspend and support the outer tub 15 in the housing 1. As shown in FIG. 2, the suspenders 16 comprises rods 17, hemispherical upper engaging portions 18, hemispherical lower engaging portions 19, and springs 20.

The outer tub 15 comprises an outer-tub cover 21 and an opening 22 having a configuration similar to the opening 6 in the cover 3 of the housing 1. A bellows 23 of rubber-like material interposes between the cover 3 and the outer-tub cover 21. The bellows 23 seals the openings 6 and 22 from the outside.

STRUCTURE OF A ROTARY SUPPORTER FOR THE FIRST EMBODIMENT

As shown in FIGS. 1 and 3, a rotary supporter 26 is formed in a cylinder having a bottom formed from synthetic resin. A balancer 27 is attached at the upper end of the rotary supporter 26. A steel board 28 reinforces the center of the bottom of the rotary supporter 26. An upper hollow shaft 29 extends downward from the steel board 28 and passes through the shield 30. The upper hollow shaft 29 is supported by a bearing 31 so that the shaft 29 can rotate about a vertical axis Y-Y. Multiple pores 33 extend horizontally in the periphery of the rotary supporter 26 to drain water. Multiple drain holes 34 extend vertically in the bottom of the rotary supporter 26 and the steel board 28.

Figure 4:
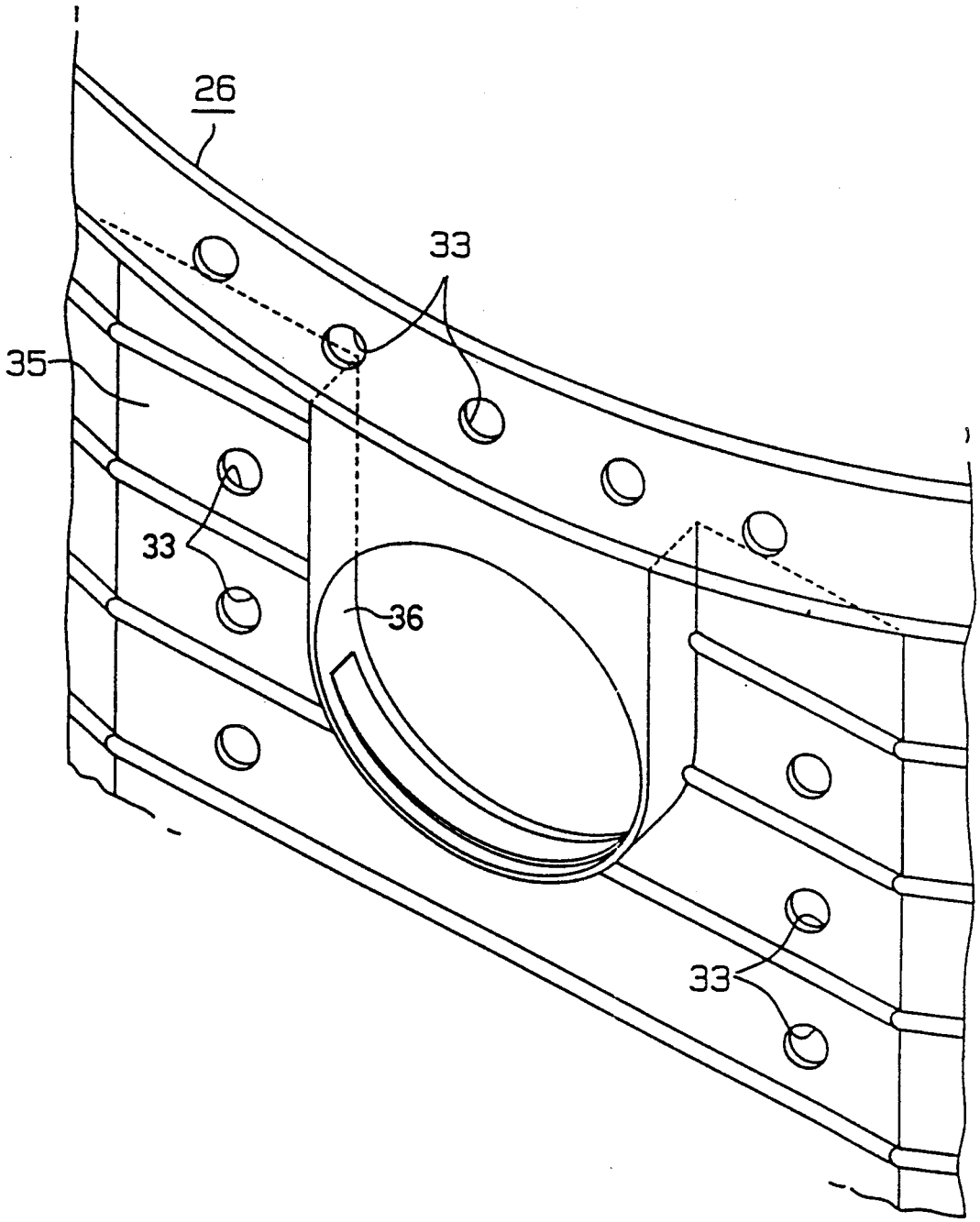
Figure 5:
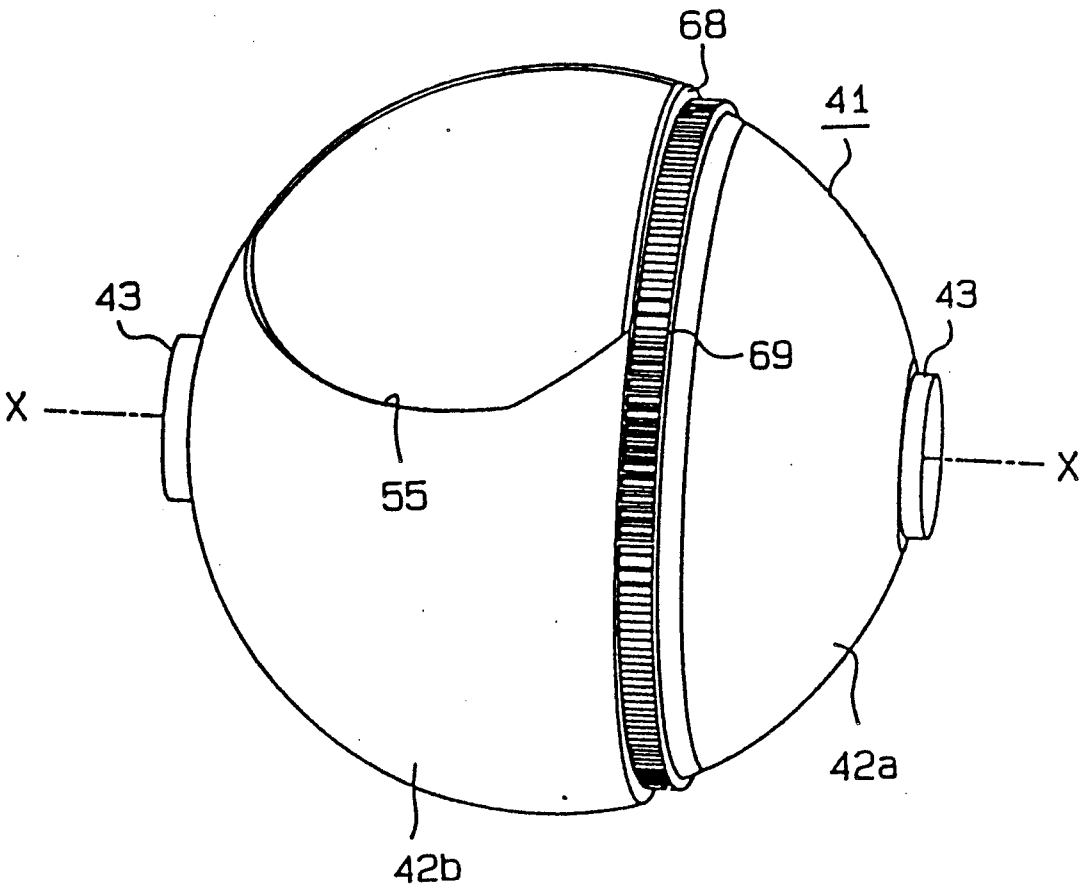
Figure 6:
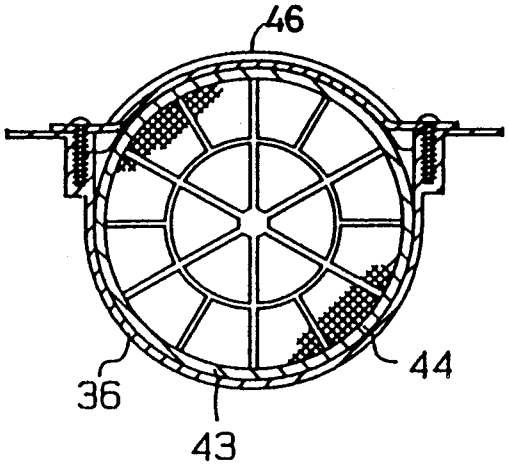

As shown in FIGS. 4 and 6, a pair of boards 35 is provided on the lower periphery of the rotary supporter 26. A pair of front and rear bearings 36 projects outward from the upper ends of the boards 35 between upper and lower halves of the rotary supporter 26 and opens into the upper half of the rotary supporter 26. The bearings 36 rotatably support cylindrical members 43 of an inner tub 41 described later.

STRUCTURE OF AN INNER TUB FOR THE FIRST EMBODIMENT

As shown in FIGS. 1, 3, 5, and 7 through 9, the spherical inner tub 41 comprises a pair of hemispherical members **42*a* and 42*b* molded from synthetic resin. A pair of short front and rear cylindrical members 43 horizontally projects outward from both sides of the inner tub 41. The rear cylindrical member 43 for introducing air to the inner tub 41 has a guard net 44 to prevent the laundry from jumping out of the inner tub 41. On the other hand, a board 45 closes the front cylindrical member 43 of the inner tub 41**.

When the inner tub 41 is inserted in the rotary supporter 26, the cylindrical members 43 engage the bearings 36 of the rotary supporter 26. As shown in FIG. 6, holders 46 are screwed onto the bearings 36 to engage the upper periphery of the cylindrical members 43 and rotatably support the cylindrical members 43. Both sides of the inner tub 41 are thus supported in the rotary supporter 26 so that the inner tub 41 rotates about a horizontal axis X-X.

Figure 7:
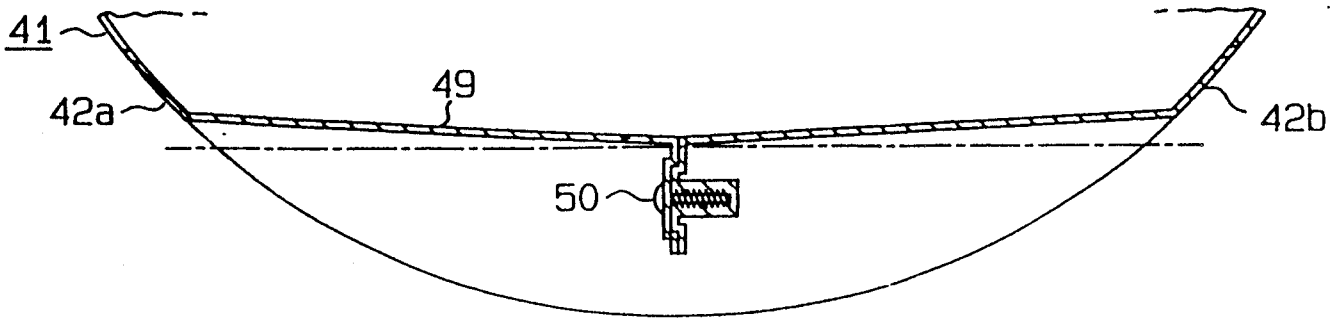
Figure 8:
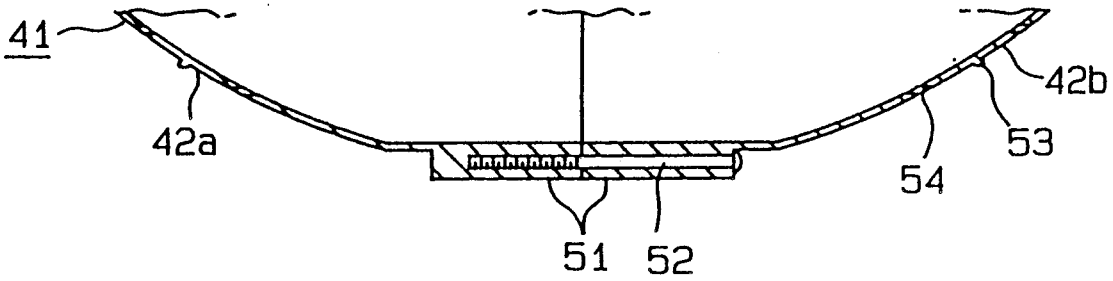

A pair of projections 49 for reversing the laundry, which extend almost in parallel with the rotation axis X-X of the inner tub 41, are spaced on the inner periphery of the inner tub 41. As shown in FIG. 7, the projections 49 are fixed using screws 50 to fasten the hemispherical members **42*a* and 42*b* of the inner tub 41. Multiple bosses 51 for reversing the laundry are provided in the inner periphery of the inner tub 41, extending in parallel with the projections 49. As shown in FIG. 8, the bosses 51 are fixed via screws 52 to fasten the hemispherical members 42*a* and 42*b* of the inner tub 41**.

Figure 9:
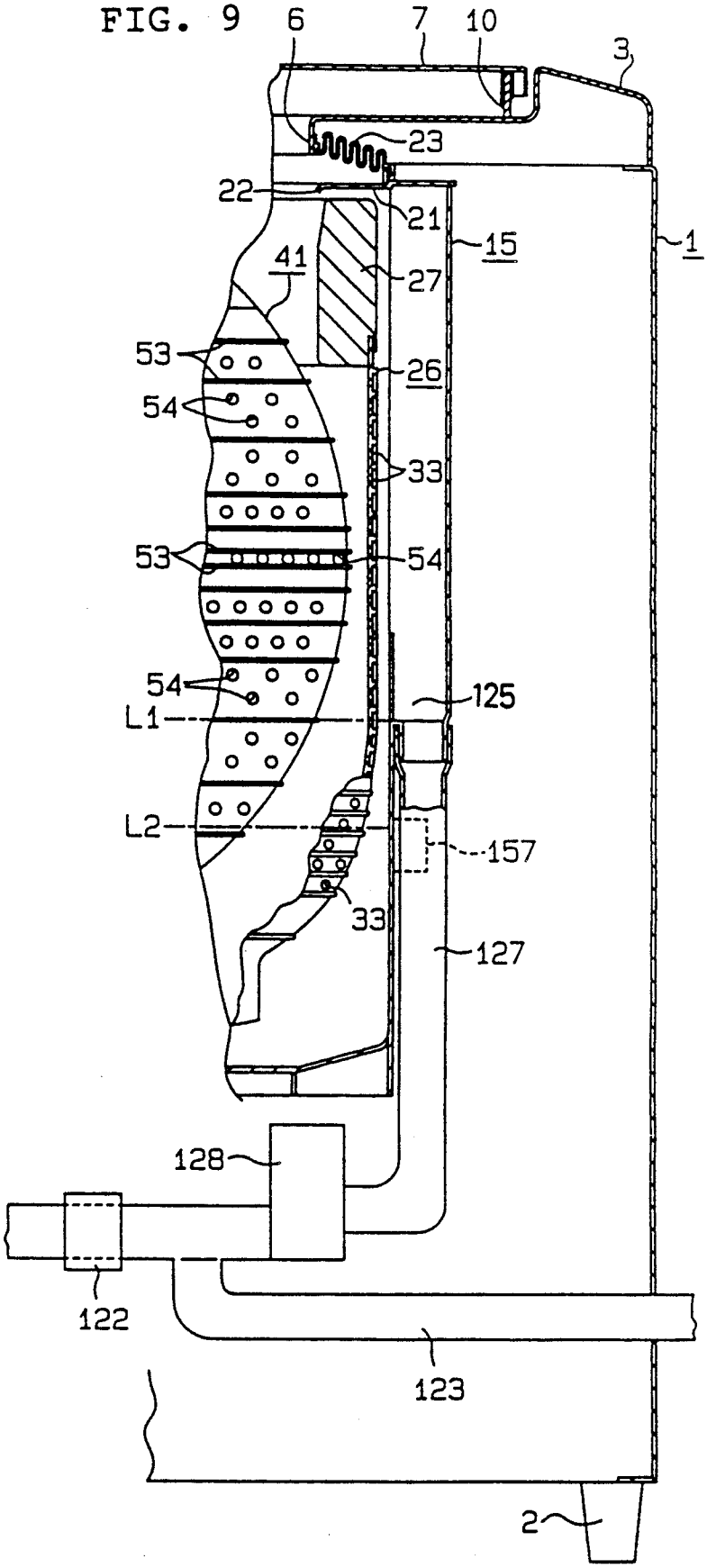

Multiple annular projections 53 are spaced at fixed intervals on the outer periphery of the inner tub 41 to reinforce the periphery of the inner tub 41. As shown in FIG. 9, the vertical distances between the projections 53 narrows near the rotation axis X-X so that the inner tub 41 can bear the concentrated load of the laundry during dehydration. Multiple pores 54 opening horizontally are formed between the projections 53 in the periphery of the inner tub 41. The opening area of the pores 54 becomes small near the rotation axis X-X on the inner tub 41. The opening area of the pores 54 far from the axis X-X expands. Since the cylindrical members 43, the projections 49 and the pores 54 are formed horizontally in the inner tub 41, the hemispherical members **42*a* and 42*b*** can be easily extracted from molds.

An opening 55 through which the laundry is loaded is provided in the periphery of the inner tub 41. The cross section of the opening 55 is half-moon-like shaped as that of the opening 6 in the cover 3 and the opening 22 in the outer tub 15. A lid 56 of synthetic resin can rotate on a hinge 57 so that the lid 56 can open or close the opening 55 in the same direction as the lid 7 opens or closes the opening 6. A spring (not shown) provides the lid 56 with a force so that the lid 56 opens by rotating counterclockwise in FIG. 1.

Multiple pores 59 opens vertically in the lid 56. A projection 61 for reversing the laundry is formed in the inner surface of the lid 56. A projection 70 is formed in the inner periphery of the inner tub 41. When the lid 56 is closed, the projection 61 and the reversing projection 70 become almost parallel with the rotation axis X-X of the inner tub 41. The projection 61 connected to the reversing projection 70 is opposed at a fixed distance to the pair of the projections 49. As shown in FIG. 3, the projections 49 and 61 are arranged every 120 degrees. Multiple dispensers 62 and 63 for containing soap, bleach, or other agent are defined by partitions 64 in the projection 61.

A locking member 66 of synthetic resin with its middle supported by a shaft 67 is rotatably attached in front of the projection 61. The locking member 66 has a click **66*a* on its end and an unlocking member 66*b* on its other end. The click 66*a* can engage the edge of the opening 55 in the inner tub 41. A spring (not shown) provides the locking member 66 with a force exerted counterclockwise in FIG. 1 to engage the locking member 66 with the edge of the opening 55 in the inner tub 41. The lid 56 is thus locked to close the opening 55 of the inner tub 41. The click 66*a* of the locking member 66 has an inclined surface. Consequently, when the lid 56 is closed, the click 66*a* of the locking member 66 contacts the edge of the opening 55 in the inner tub 41, and the click 66*a* once contracts against the force of the spring. After the click 66*a* passes the edge of the opening 55, the click 66*a* returns to its original form due to the spring force and engages the edge of the opening 55**.

A rim 68 is put in parallel around the outer periphery of the hemispherical member 42*a* of the inner tub 41. A non-driven gear 69 is formed on the outer periphery of the rim 68. The non-driven gear 69 forms an outermost periphery of the inner tub 41, centering on the horizontal rotation axis X-X. The upper end of the non-driven gear 69 is covered with the cover 21.

The outer diameter of the inner tub 41 is larger than the inner diameter of the balancer 27 of the rotary supporter 26. When the inner tub 41 stands still, the lower edge of the opening 55 in the inner tub 41 is positioned above the lower edge of the balancer 27. The laundry is thus prevented from falling through the space between the lower edges of the opening 55 and the balancer 27 into the space between the inner tub 41 and the rotary supporter 26.

DRIVE MECHANISM FOR THE INNER TUB AND THE ROTARY SUPPORTER FOR THE FIRST EMBODIMENT

As shown in FIG. 1, a motor 75, which drives the inner tub 41 and the rotary supporter 26 to rotate, can rotate forward and in reverse. The motor 75 is attached via brackets (not shown) under the outer tub 15.

A motor-cooling fan 102 is attached to a vertically extending motor shaft of the motor 75. A driving pulley 76 is also fixed on the vertically extending shaft of the motor 75. A lower hollow shaft 77 is rotatably supported under the upper hollow shaft 29 on the vertical axis Y-Y. A support board 78 supports a bearing 79 and the bearing 79 supports the lower hollow shaft 77. A gear housing 80 connects the upper and lower hollow shafts 29 and 77. A lower rotating shaft 81 is supported by a support metal in the lower hollow shaft 77 so that the shaft 81 rotates relative to the lower hollow shaft 77. A driven pulley 84, which is attached to the lower end of the lower rotating shaft 81, is connected via a belt 83 to the driving pulley 76. A clutch coupling 82 is also fixed to the lower end of the lower rotating shaft 81.

An upper rotating shaft 85 is supported by a support metal in the upper hollow shaft 29 so that the shaft 85 can rotate relative to the upper hollow shaft 29. A bevel gear 86 is fixed on the upper end of the upper rotating shaft 85. A gear cover 87 of synthetic resin is attached watertight through a packing 88 on the steel board 28 on the bottom of the rotary supporter 26. A non-driven rotating shaft 89 extending horizontally is supported by a bearing 90 in the gear cover 87. The non-driven rotating shaft 89 has on its end a bevel gear 91 which meshes with the bevel gear 86 in the gear cover 87, and on its other end a driven gear 92 which meshes with the non-driven gear 69 on the periphery of the inner tub 41. The driven gear 92 cooperates the non-driven gear 69 to construct a decelerating drive mechanism.

Figure 12:
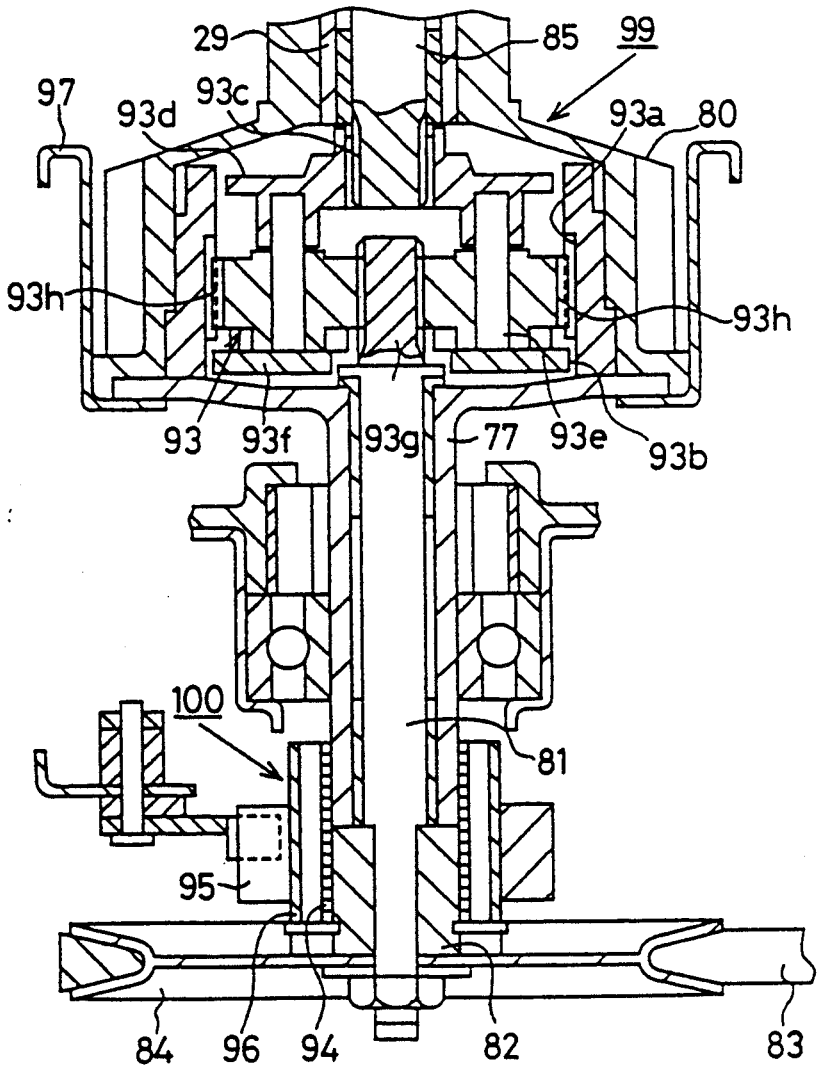

As shown in FIG. 12, an epicycle reduction gear 93 is provided between the upper and lower rotating shafts 81 and 85 in the gear housing 80. An inner teeth gear 93*a* of the epicycle reduction gear 93 is fixed to the inner surface of the gear housing 80. A rotating member 93*b* is provided with an upper disk 93*d* that can rotate together with the upper rotating shaft 85 via a spline combination 93*c*. Multiple supporting shafts 93*e* are suspended from and fixed to the upper disk 93*d*. The lower ends of the supporting shafts 93*e* are fixed to a lower disk 93*f* of the rotating member 93*b*.

Multiple planetary gears 93*h* are rotatably supported around the supporting shafts 93*e* on the lower disk 93*f*. The planetary gears 93*h* engage with a sun gear 93*g* provided on the upper end of the lower rotating shaft 81 and with the inner teeth gear 93*a*. Consequently, when the sun gear 93*g* is rotated together with the lower rotating shaft 81, the rotation is transmitted to the respective planetary gears 93*a* and to the upper rotating shaft 85 via the spline combination 93*c*, thus the upper rotating shaft 85 having a decelerated rotational velocity.

A spring clutch 94 is attached on the outer periphery of the clutch coupling 82. When a clutch click 95 is released from a clutch housing 96, the lower rotating shaft 81 is connected with the lower hollow shaft 77 through the spring clutch 94. On the other hand, when the clutch click 95 snaps into the clutch housing 96, the lower rotating shaft 81 is disconnected from the lower hollow shaft 77. A brake drum 97 is provided on the outer periphery of the gear housing 80. When a brake body 98 contacts the brake drum 97, the rotary supporter 26 as well as the upper and lower hollow shafts 29 and 77 is stopped.

During the washing, rinsing and drying of the laundry, the spring clutch 94 disengages and the brake body 98 works. Subsequently, the rotation of the motor 75 is transmitted through the driving pulley 76, the belt 83, the driven pulley 84, the lower rotating shaft 81, the epicycle reduction gear 93, the upper rotating shaft 85, the bevel gears 86 and 91, the non-driven rotating shaft 89, the driven gear 92, and the non-driven gear 69 to the inner tub 41. The inner tub 41 rotates around the horizontal rotation axis X-X at low speed of about 30 rpm.

On the other hand, during the dehydrating of the laundry, the spring clutch 94 engages and the brake body 98 disengages. The rotation of the motor 75 is then transmitted through the driving pulley 76, the belt 83, and the driven pulley 84 to the lower rotating shaft 81. At the same time, the rotation of the clutch coupling 82 is transmitted through the spring clutch 94 to the lower hollow shaft 77. Subsequently, the rotation of the lower hollow shaft 77 is transmitted through the gear housing 80 to the upper hollow shaft 29. The rotary supporter 26 as well as the inner tub 41 rotates around the vertical rotation axis Y-Y at high speed of about 900 rpm. Since the upper rotating shaft 85 rotates together with the upper hollow shaft 29, the non-driven rotating shaft 89 does not axially rotate about its axis. Instead, the entire non-driven rotating shaft 89 rotates with the rotary supporter 26 about the vertical axis Y-Y. Therefore, the inner tub 41 does not rotate about the horizontal axis X-X.

The drive mechanism including the epicycle reduction gear 93 and the non-driven gear 69 composes an inner-tub rotation drive mechanism 99 for rotating the inner tub 41 when the laundry is washed, rinsed and dried. The lower hollow shaft 77, the gear housing 80, the upper hollow shaft 29, and the spring clutch 94 compose a dehydrating drive mechanism 100 for rotating the rotary supporter 26 when the laundry is dehydrated. The drive mechanism including the clutch coupling 82, the motor 75, and the lower rotating shaft 81 composes a rotation drive means.

STRUCTURE FOR REMOVING LINT AND OTHER FOREIGN OBJECTS FOR THE FIRST EMBODIMENT

Two holes 104 are located in the periphery of the inner tub 41, opposing the opening 55. When the inner tub 41 is stopped, the holes 104 are positioned below the rotation axis X-X of the inner tub 41. Lint or other foreign objects can be removed through the holes 104 from the gear cover 87 and the driven gear 92 in the bottom of the rotary supporter 26. Covers 107 for closing the holes 104 are detachably attached onto the holes 104.

STRUCTURE FOR WATER SUPPLY OF THE FIRST EMBODIMENT

As shown in FIGS. 1, 3, and 10, a water supply 111 for supplying water to the outer tub 15 comprises a water supply valve 112 in the housing 3. An end connection 113, which opens at the rear of the housing 3, can be connected via a hose or other connecting members to a faucet or other water sources.

A first water passage 114 is connected to the other end of the water supply valve 112. A first water outlet 115 provided on the end of the first water passage 114 opens ahead of the horizontal rotation axis X-X in the rotating direction of the rotation of the inner tub 41 above the outer periphery of the inner tub 41. A second water passage 116 branched through a flexible pipe 117 from the first water passage 114 has a second water outlet 118 on its end. The second water outlet 118, which opens in an air passage 142 of a warm-air supply device 134, supplies water through the air passage 142 and the rear cylindrical member 43 into the inner tub 41.

To supply water before washing or rinsing the laundry, the water-supply valve 112 opens and supplies water through the first and second water outlets 115 and 118 to the upper outer periphery of the inner tub 41 and into the inner tub 41. Before rinsing the laundry, water is supplied from the first water outlet 115 to the outer periphery of the inner tub 41 to flush soap bubbles from the outer periphery of the spherical inner tub 41. Water is further supplied from the second water outlet 118 through the air passage 142 into the inner tub 41, rinsing soap and bubbles out of the laundry in the inner tub 41.

STRUCTURE FOR DRAIN AND OVERFLOW WATER OF THE FIRST EMBODIMENT

As shown in FIGS. 1, 9 and 10, a drain outlet 121 is provided at the bottom of the outer tub 15. The drain outlet 121 is connected through a drain valve 122 to a drain hose 123. A solenoid 124 opens or closes the drain valve 122. The operation of the drain valve 122 interlocks with the operation of the click 95 of the spring clutch 94 and that of the brake body 98. Specifically, when the laundry is washed, rinsed and dried, the spring clutch 94 disengages from the clutch housing 96, the brake body 98 connects the brake drum 97, and the drain valve 122 closes. During the dehydrating of the laundry, when the spring clutch 94 connects the clutch housing 96 and the brake body 98 disconnects from the brake drum 97, the drain valve 122 opens.

An overflow water outlet 125 in the periphery of the outer tub 15 functions as a warm-air exhaust port. The overflow water outlet 125 is opposed to the rear cylindrical member 43 for supplying warm air in the inner tub 41. An overflow water hose 127 is between the overflow water outlet 125 and the drain hose 123. A cooling chamber 128 between the overflow water outlet 125 and the drain hose 123 cools and dehydrates hot and humid air resulting from the drying process. The overflow water outlet 125 below the rear cylindrical member 43 of the inner tub 41 discharges a larger amount of water than that of water supplied from the first and second water outlets 115 and 118. As shown in FIG. 9, when the laundry is rinsed, the outer tub 15 holds water up to a level L1 which level is below the horizontal rotation axis X-X of the inner tub 41. The level L1 is above a level L2 determined according to the amount of the laundry. To wash the laundry, water is supplied up to the level L2.

STRUCTURE OF A WARM-AIR SUPPLY DEVICE FOR THE FIRST EMBODIMENT

Figure 11:
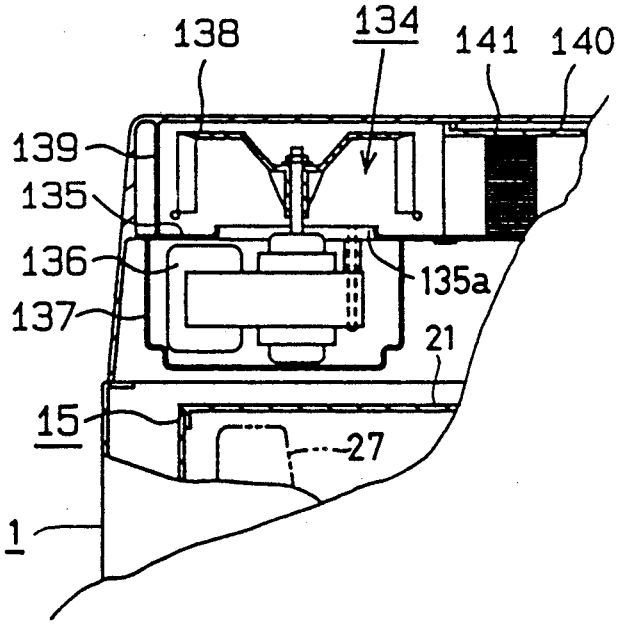

As shown in FIGS. 1, 10 and 11, the warm-air supply device 134 as a heating means is supported between the housing 1 and the cover 3 above the tubs 15, 26 and 41. When the laundry is dried, the warm-air supply device 134 supplies warm air into the inner tub 41 and raises the temperature of air in the inner tub 41.

The warm-air supply device 134 comprises a steel board 135 formed in the top inner surface of the cover 3. A fan motor 136 is attached under the steel board 135, and a motor cover 137 of synthetic resin attached under the steel board 135 covers the fan motor 136. In the outer periphery of the motor cover 137, an air inlet (not shown) opens at the rear of the cover 3. A fan 138 above the steel board 135 is fixed on the shaft of the fan motor 136 and is covered by a guide rib 139 formed as one piece with the top inner surface of the cover 3. The steel board 135 has an opening **135*a* through which the shaft of the motor 136** passes.

An air guide 140 of cylindrical heat-resistant synthetic resin is connected to the guide rib 139 and is screwed onto the inner surface of the cover 3. A heater 141 is provided inside the air guide 140. The air passage 142 slopes downward at the middle of the rear of the outer tub 15 and the outer-tub cover 21. A bellows 143 connects the ends of the air guide 140 and the air passage 142. When the fan motor 136 rotates the fan 138, air of the outside is introduced through the motor cover 137, the opening **135*a*, and the guide rib 139 into the heater 141. The heater 141 then heats and sends out air to the air passage 142 and the air guide 140**.

An air outlet 144 is connected from the lower end of the air passage 142 into the rear wall of the outer tub 15 and is opposed at a slight distance to the rear bearing 36 of the rotary supporter 26 and the rear cylindrical member 43 of the inner tub 41. Since the open area of the rear bearing 36 and the rear cylindrical member 43 is larger than that of the air outlet 144, warm air can be effectively introduced from the warm-air supply device 134, the air passage 142, the rear bearing 36 and the rear cylindrical member 43 into the inner tub 41.

STRUCTURE OF SENSORS FOR THE FIRST EMBODIMENT

As shown in FIG. 1, a lid switch 148 in the cover 3 is opposite to the lid 7. When the lid 7 rotates by a fixed angle to close, the lid switch 148 issues a detection signal. A lid-locking switch 149 in the cover 3 is opposite to the locking lever 11. When the locking lever 11 locks the lid 7, the lid-locking switch 149 issues a detection signal. A lid sensor 150 consisting of element for receiving and throwing light is opposite to a reflecting board 151 at the rear of the opening 6 in the cover 3. When the locking member 66 insufficiently locks the lid 56 of the inner tub 41 and the lid 56 opens contacting the lid 7 due to the force of the spring (not shown), the sensor 150 issues a detection signal. When the lids 7 and 56 are closed and locked, the lid switch 148 and the lid-locking switch 149 issue detection signals, and the sensor 150 issues no detection signals. The washing machine of the first embodiment is thus ready to operate. When either or both of the lids 7 and 56 are opened, the lid switch 148 or the lid-locking switch 149 issues no detection signals, and the sensor 150 issues a detection signal. The washing machine of the first embodiment wither cannot start or stops operating.

A magnet 152 on the balancer 27 of the rotary supporter 26 is a first detected body. A sensor 153 as a first detector consisting of Hall elements is positioned on the cover 21 so that the sensor 153 is aligned with the magnet 152. When the sensor 153 detects the magnet 152, the sensor 153 issues a signal indicating the detection of the position of the rotary supporter 26. After the laundry is dehydrated, a first positioned stop means comprising the magnet 152 and the sensor 153 stops the rotation of the rotary supporter 26 at a predetermined position where the rear bearing 36 of the rotary supporter 26 faces the air outlet 144 of the outer tub 15.

A magnet 154, which is provided on the middle of the outer periphery of the inner tub 41 behind the lid 56, is a second detected body. A sensor 155 as a second detector consisting of Hall elements is positioned on the cover 21 so that the sensor 155 is aligned with the magnet 154. When the sensor 155 detects the magnet 154, the sensor 155 issues a signal indicating the detection of the position of the inner tub 41. After the laundry is washed, rinsed, dehydrated or dried, a second positioned stop means comprising the magnet 154 and the sensor 155 stops the inner tub 41 at a predetermined position where the lid 56 of the inner tub 41 is aligned with the opening 22 in the cover 21.

An excess-vibration detecting switch 156, which is provided opposite to the upper outer periphery of the outer tub 15 in the housing 1 detects abnormal vibration of the outer tub 15. During the dehydrating of the laundry, when the rotary supporter 26 vibrates excessively and rotates abnormally due to the concentrated load of the laundry in the inner tub 41, and the outer tub 15 contacts the excess-vibration detecting switch 156, the excess-vibration detecting switch 156 then issues a detection signal. A water-level sensor 157 comprising a pressure switch is provided on the outer surface of the outer tub 15. The water supply 111 supplies water into the outer tub 15 before washing the laundry. When the level L2 reaches a predetermined level in the inner tub 41, the sensor 157 issues a detection signal, stopping the supply of water.

STRUCTURE OF A CONTROL CIRCUIT FOR THE FIRST EMBODIMENT

Figure 13:
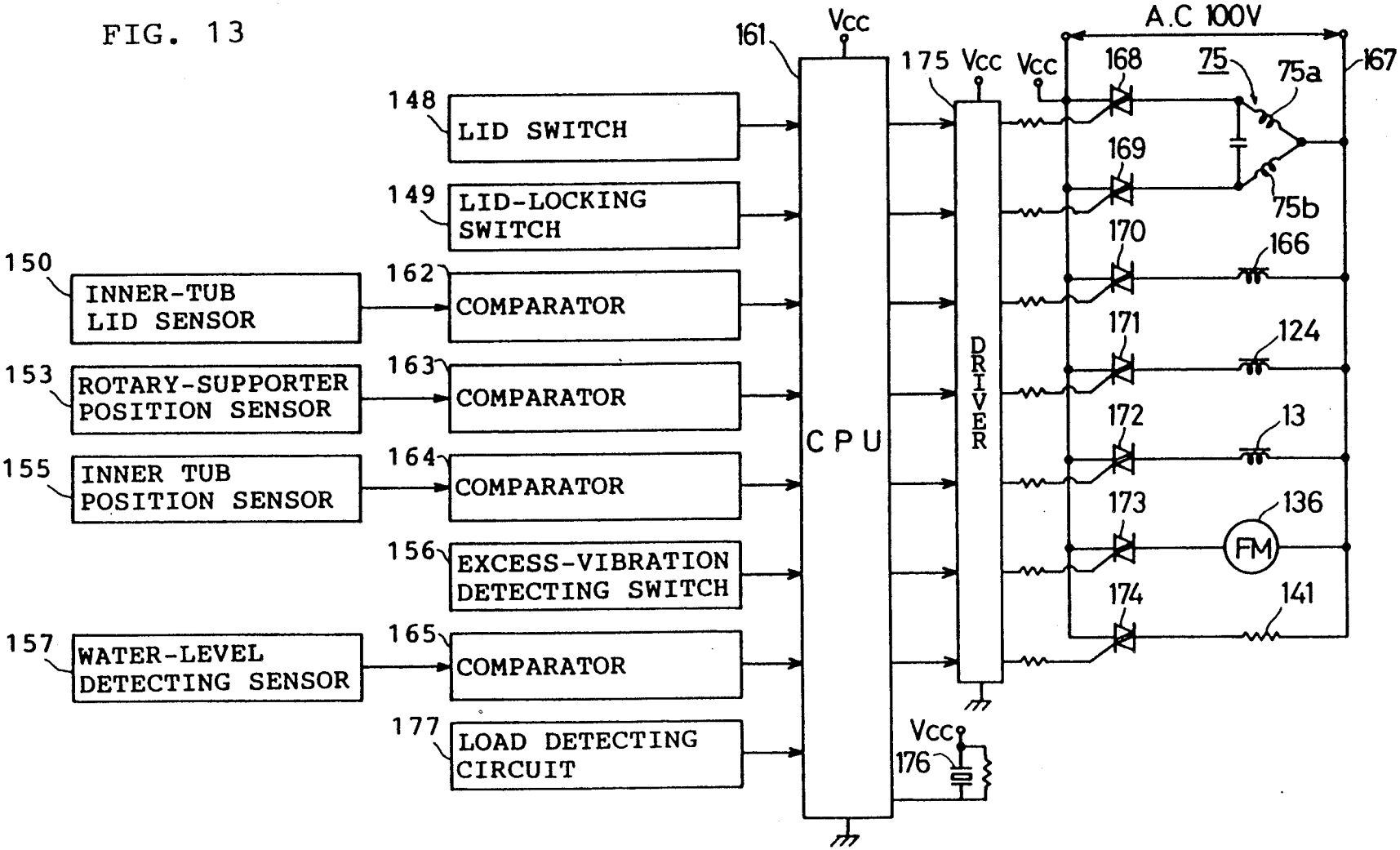

As shown in FIG. 13, a central processing unit (CPU) 161 composes a control means and determines and stores data required for controlling the operation of the machine of the first embodiment such as a water level for washing the laundry and a set cycle for washing, rinsing, dehydrating, and drying the laundry. The lid switch 148, the lid-locking switch 149 and the excess-vibration detecting switch 156 send detection signals to the CPU 161. The CPU 161 also receives detection signals through comparators 162 through 165 from the sensors 150, 153, and 155, and the water-level detecting sensor 157.

On the other hand, main and auxiliary windings 75*a* and 75*b* of the motor 75, a water-supply valve solenoid 166, the solenoid 124 for the drain valve 122 and the clutch 94, the solenoid 13, and the fan motor 136 and the heater 141 for the warm-air supply device 134 are juxtaposed via triode AC switches 168 through 174 to an AC power circuit 167. The CPU 161 sends an operation signal through a driver 175 and resistors to gate terminals of the triode AC switches 168 through 174.

A piezoelectric buzzer 176 connected to the output side of the CPU 161 makes a buzzing sound driven by the CPU 161 when a cycle of washing through drying processes ends or when trouble occurs such as the opening of the lid 56.

A load-detecting circuit 177 comprises a current-detecting converter provided on a circuit for supplying current to the main winding 75*a* of the motor 75. When the inner tub 41 loaded with the laundry rotates a specified number of times prior to the washing of the laundry, the load-detecting circuit 177 detects the load of the laundry according to current flowing through the main winding 75*a* of the motor 75 and sends the detected load to the CPU 161. The CPU 161 determines time period for each of the washing, rinsing, dehydrating, and drying processes of the laundry according to the load detected by the load-detecting circuit 177. When the laundry is dehydrated, the rotary supporter 26 may vibrate excessively and rotate abnormally due to the unbalanced load of laundry in the inner tub 41. When the excess-vibration detecting switch 156 detects the abnormal rotation of the rotary supporter 26, the dehydrating drive mechanism 100 disengages, stopping the rotation of the rotary supporter 26. Subsequently, the inner-tub rotation drive mechanism 99 rotates the inner tub 41 forward and in reverse a specified number of times. The eccentric load of the laundry in the inner tub 41 is thus corrected.

OPERATION OF THE FIRST EMBODIMENT

Figure 14:
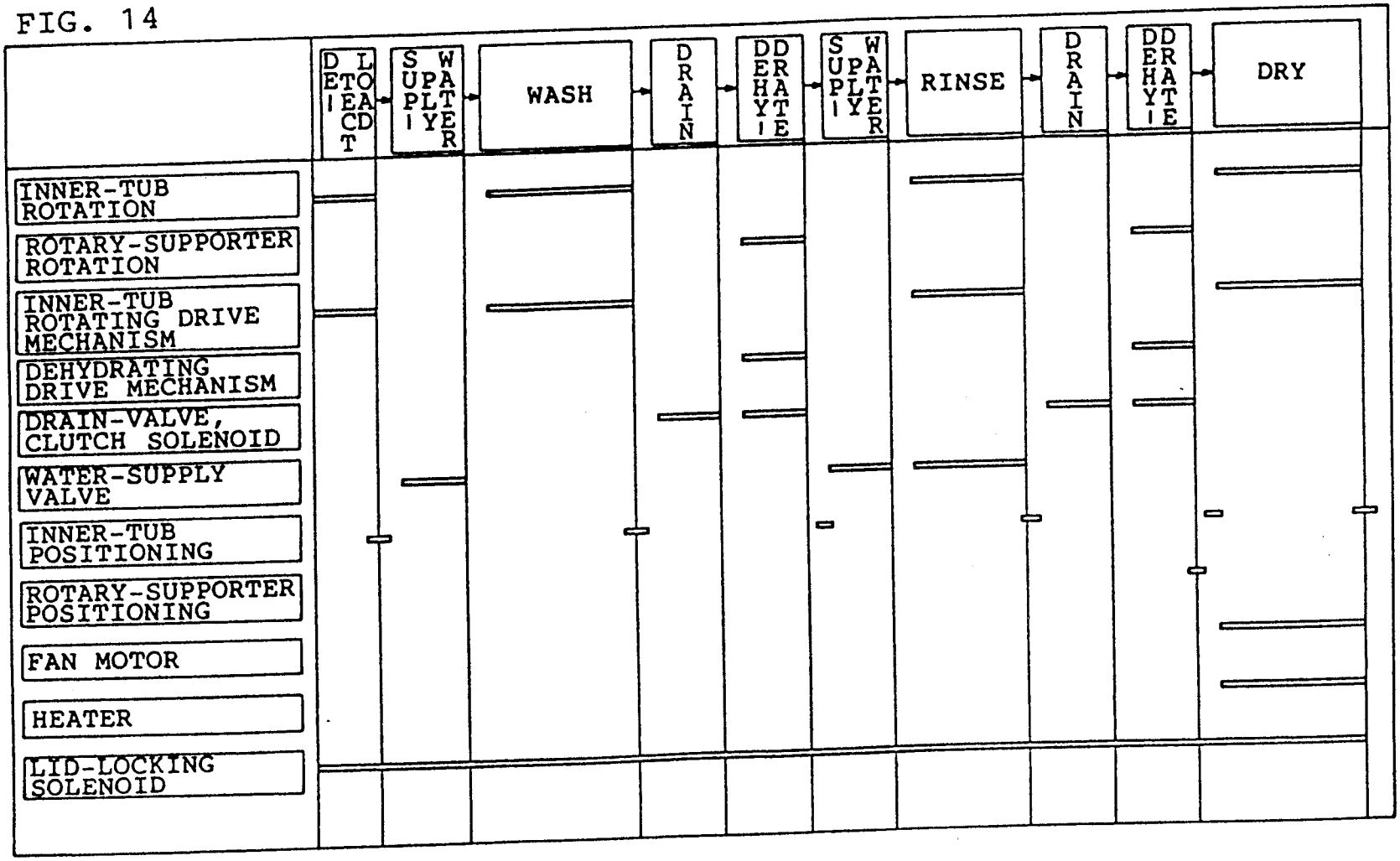

The above-constructed washing and dehydrating machine of the first embodiment operates as follows:

First, the lids 7 and 56 are opened, the laundry is loaded into the inner tub 41, the lid 56 is closed, soap, bleach or other agent is put in the dispensers 62 and 63, the lid 7 is closed, and a starting switch (not shown) is pressed. Under the control of the CPU 161, a series of processes shown in the time chart in FIG. 14 is executed automatically. First, the inner-tub rotating drive mechanism 99 rotates the inner tub 41, the load-detecting circuit 177 detects the load of the laundry in the inner tub 41, and the time for the washing process is determined.

Subsequently, the water supply 111 supplies water, the inner-tub rotating drive mechanism 99 rotates the inner tub 41 about the horizontal axis X-X to wash the laundry, the drain valve 122 opens to drain water, and the dehydrating drive mechanism 100 rotates the inner tub 41 and the rotary supporter 26 together about the vertical axis Y-Y to dehydrate the laundry. After the laundry is dehydrated, the water supply 111 supplies water, and the inner-tub rotating drive mechanism 99 rotates the inner tub 41 about the horizontal axis X-X to rinse the laundry. After the laundry is rinsed, the drain valve 122 opens to drain water and the dehydrating drive mechanism 100 rotates the inner tub 41 and the rotary supporter 26 together about the vertical axis Y-Y to dehydrate the laundry. After dehydrating the laundry, the warm-air supply device 134 supplies warm air to the inner tub 41 and the inner-tub rotating drive mechanism 99 rotates the inner tub 41 about the horizontal axis X-X to dry the dehydrated laundry.

The washing, rinsing, dehydrating and drying processes executed by the machine of this invention are explained in detail.

The laundry is washed when the inner-tub rotation drive mechanism 99 rotates the inner tub 41 about the horizontal axis X-X. In the inner tub 41, the projections 49 and 61 and the bosses 51 tumble and beat the laundry.

To dehydrate the laundry, the spring clutch 94 engages and the brake body 98 disengages. The dehydrating drive mechanism 100 is thus put into operation. The drain valve 122 opens, draining water from the outer tub 15. The rotary supporter 26, driven by the motor 75, rotates about the vertical axis Y-Y to dehydrate the laundry. Since the spring clutch 94 composing the dehydrating drive mechanism 100 engages, the upper rotating shaft 85 rotates together with the upper hollow shaft 29. The dehydrating drive mechanism 100 engaging with the inner-tub rotation drive mechanism 99 is connected to the lower hollow shaft 77. Consequently, the inner-tub 41 is prevented from rotating about the horizontal axis X-X. The inner-tub 41 rotates together with the rotary supporter 26 in the same direction about the vertical axis Y-Y at the same speed.

When the laundry is rinsed, in the same way as the washing process, the inner tub 41 is rotated about the horizontal axis X-X. At the same time, water is supplied through the first and second water outlets 115 and 118 to the inner tub 41. While water is continuously supplied, water used for rinsing the laundry is discharged from the overflow water outlet 125, thus keeping the water level in the outer tub 15 the same. When water is discharged from the overflow water outlet 125 to the outside, bubbles are also flushed away through the overflow water outlet 125.

When the laundry is dried, the inner tub 41 rotates about the horizontal axis X-X. In the same way as the washing process, the projections 49 and 61 and the bosses 51 tumble the laundry in the inner tub 41. The laundry is thus agitated in the inner tub 41. At the same time, the warm-air supply device 134 supplies warm air into the inner tub 41 to dry the laundry.

DETECTION OF CLOSED LIDS FOR THE FIRST EMBODIMENT

Figure 15:
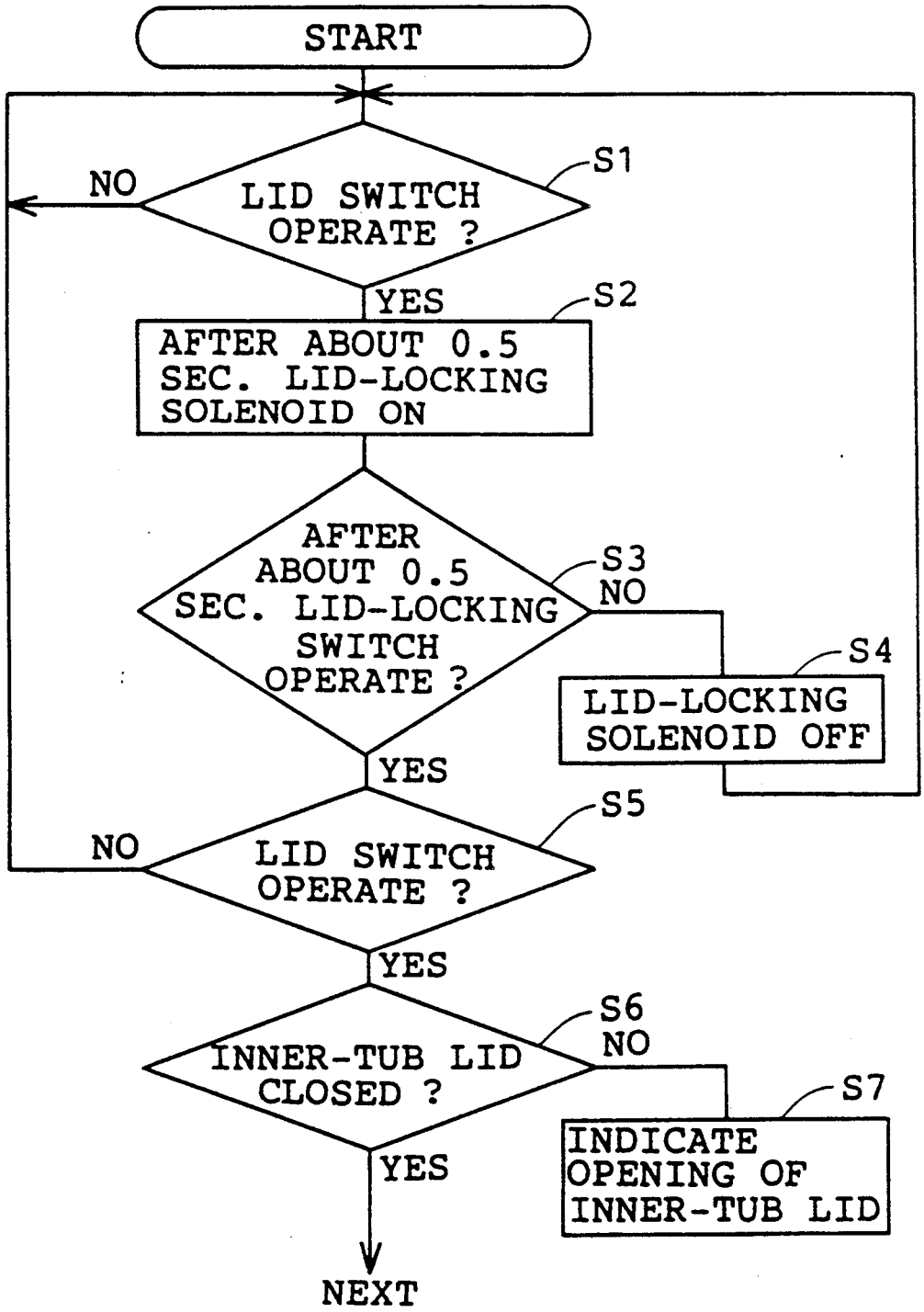

It is confirmed whether the lids 7 and 56 are closed through process shown in the flowchart of FIG. 15.

After closing the lid 56, the lid 7 is between three and five degrees above horizontal. The lid switch 148 operates at step S1. At step S2 about 0.5 seconds after the lid switch 148 detects the lid 7 is closed, the solenoid 13 turns on and the locking lever 11 can lock the lid 7. When the lid 7 is completely closed, the locking lever 11 locks the lid 7 and the lid 7 is locked until the series of the operation as aforementioned ends.

At step S3, about 0.5 seconds after the solenoid 13 is energized, the lid-locking switch 149 confirms that the lid 7 is locked. When the lid 7 is not locked, at step S4 the solenoid 13 turns off and the process goes back to step S1. When the lid 7 is locked, it is confirmed at step S5 whether the lid switch 148 operates. When the lid switch 148 does not work, the process goes back to step S1. Consequently, the lid-switch 148 and the lid-locking switch 149 both confirm that the lid 7 is closed.

After the lid switch 148 operates, at step S6 the lid sensor 150 detects whether the inner-tub lid 56 is closed. When the locking member 66 locks the lid 56, the process goes to the next. When the inner-tub lid 56 is insufficiently locked and contacts the underside of the lid 7 due to the force of the spring, at step S7 the sensor 150 detects that the lid 56 is opened and the piezoelectric buzzer 176 indicates trouble with the lid 56.

SETTING OF OPERATION TIME FOR THE FIRST EMBODIMENT

Figure 16:
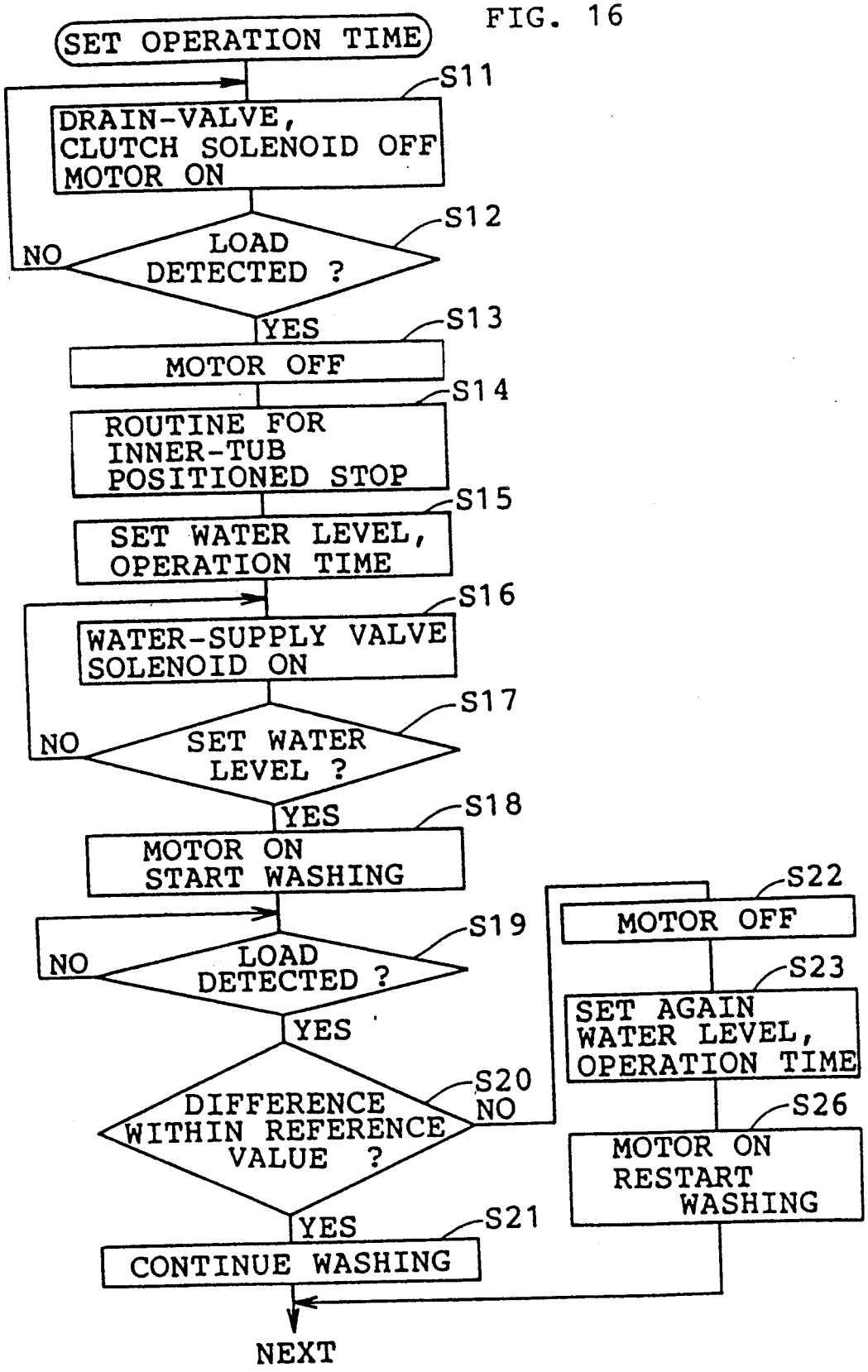

Subsequently, operation time is determined according to the detected load of the laundry through processes as shown in the flowchart of FIG. 16.

At step S11 the solenoid 124 for the drain valve 122 and the spring clutch 94 turns off, and the motor 75 rotates forward and in reverse, rotating the inner tub 41 about the horizontal axis X-X. When the inner tub 41 rotates, at step S12 the load-detecting circuit 177 detects the load of the laundry according to the electrical current loaded on the motor 75 and sends a detection signal to the CPU 161. The loads are detected when the inner tub 41 rotates for the first time and the second time, and these detected loads are averaged.

At step S13, the motor 75 is stopped. Subsequently, at step S14, the inner-tub position sensor 155 detects the magnet 154 on the inner tub 41 and the inner tub 41 stops at a predetermined position through the routine described later. At next step S15, the water level 12 and the period of time required for washing, rinsing, dehydrating or drying the laundry is determined according to the load detected by the load-detecting circuit 177. At step S16, the water-supply valve solenoid 166 turns on and the water-supply valve 112 opens to supply water through the first and second water outlets 115 and 118 to the outer tub 15. When at step S17 water in the outer tub 15 reaches the specified level L2, at step S18 the motor 75 rotates forward and the inner tub 41 rotates, thus starting washing the laundry. Subsequently, at step S19 the load-detecting circuit 177 detects the load of laundry again. After the load detected at step S19 is compared with that detected at step S12, it is determined at step S20 whether the difference between the loads is within a reference value. When the difference is within the reference value, the process goes to step S21 which continues the washing process. When the difference exceeds the reference value, step S22 stops the motor 75. Subsequently, step 23 determines again the period of time for washing, rinsing, dehydrating, or drying the laundry and the water level L2 according to the average value between the loads detected at steps S12 and S19. At step S26 the motor 75 rotates, thus restarting washing the laundry and the process goes to the next dehydrating and drying processes.

POSITIONED STOP OF THE INNER TUB FOR THE FIRST EMBODIMENT

Figure 17:
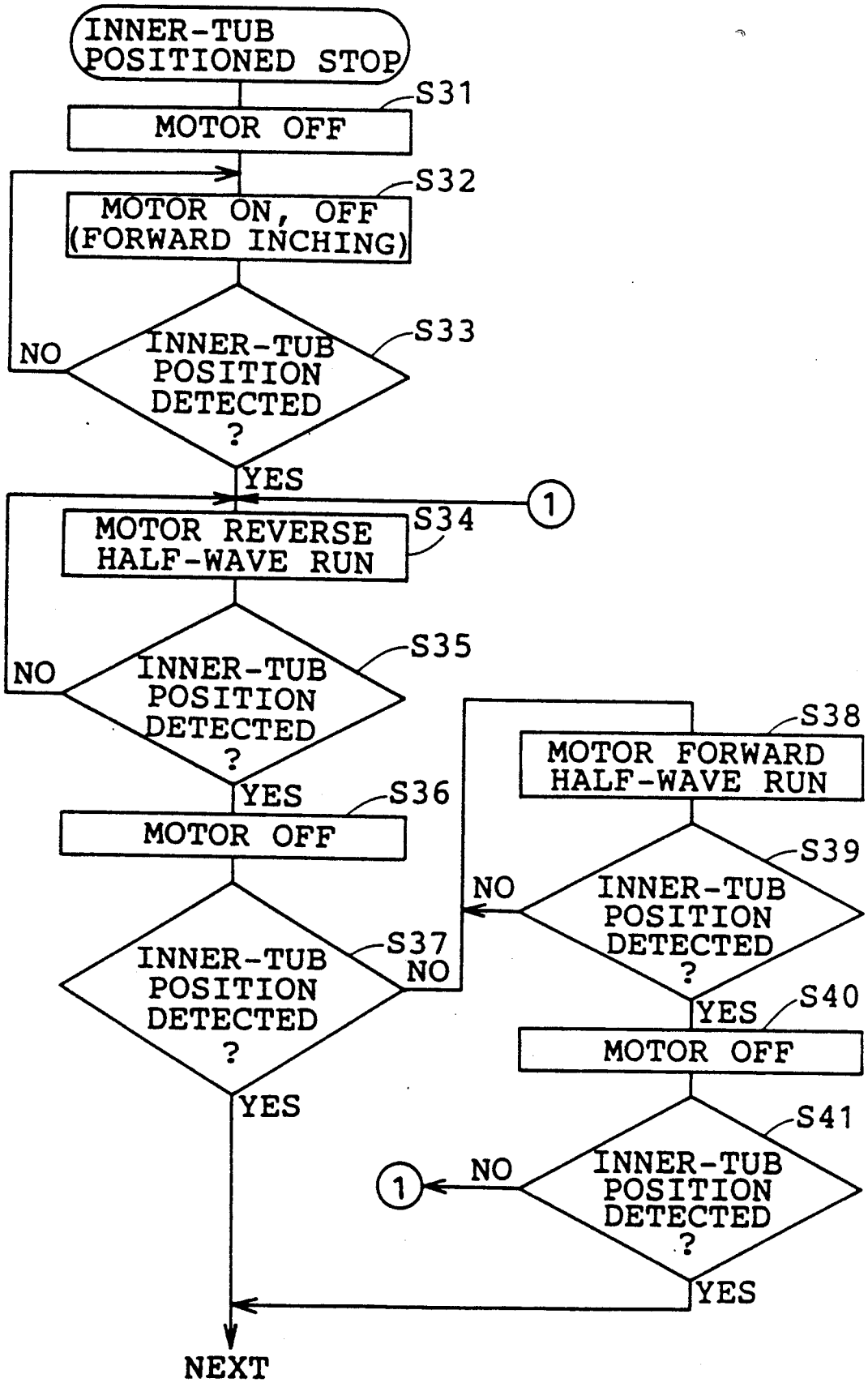

After the laundry is washed or dried, the inner tub 41 is stopped at a predetermined position through the routine shown in the flowchart of FIG. 17.

After the laundry is washed or dried, at step S31 the motor 75 is stopped. After the inner tub 41 is stopped, at step S32 the motor 75 rotates forward inch by inch, rotating the inner tub 41 at low speed. When at step S33 the sensor 155 detects the magnet 154 of the inner tub 41, at step S34 the motor 75 reverses by half-wave electric current.

Subsequently, at step S35 the inner-tub position sensor 155 detects the magnet 154 and sends a detection signal to the CPU 161. At step S36 the motor 75 stops, stopping the rotation of the inner tub 41. After the motor 75 stops, at step S37 the inner-tub position sensor 155 detects again the magnet 154 and sends a detection signal to the CPU 161. After step S37 thus detects the position of the inner tub 41, the process goes to the next.

When at step S37 the inner-tub position sensor 155 sends no detection signal to the CPU 161, the process goes to step S38 where the motor 75 rotates forward using half-wave electric current and the inner tub 41 rotates forward at low speed. Subsequently, at step S39 the inner-tub position sensor 155 sends a detection signal to the CPU 161, and at step S40 the motor 75 stops and the inner tub 41 stops rotating. After the motor 75 stops, at step S41 the inner-tub position sensor 155 detects the position of the inner tub 41 and sends a detection signal to the CPU 161. When it is thus determined that the inner tub 41 stops at the predetermined position, the process goes to the next.

CORRECTION OF ABNORMAL ROTATION OF INTERMEDIATE TUB FOR THE FIRST EMBODIMENT

Figure 18:
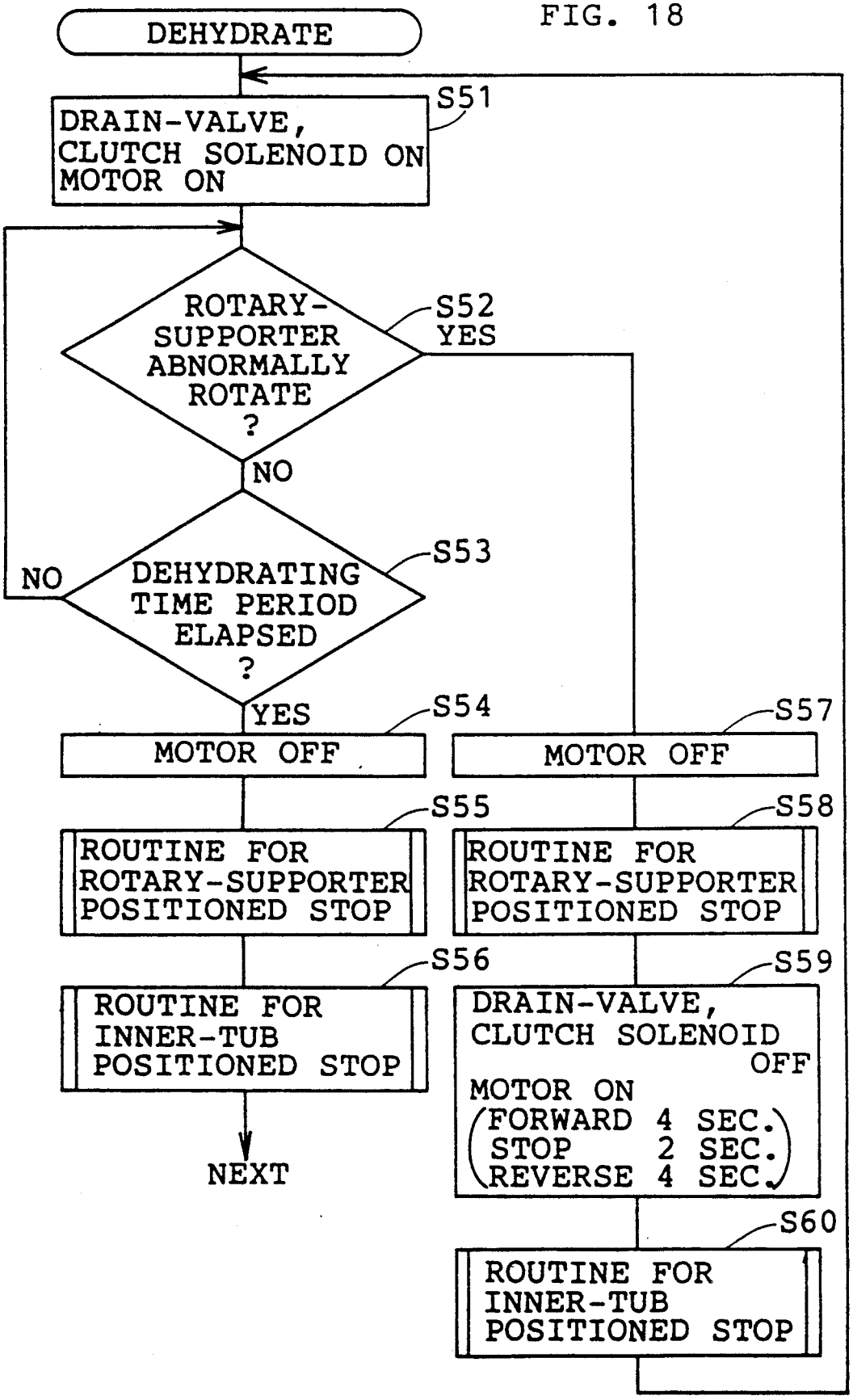

Trouble with the rotation of the rotary supporter 26 when the laundry is hydrated is solved through the routine in the flowchart of FIG. 18.

When the laundry washed and rinsed as aforementioned is dehydrated, at step 51 the solenoid 124 turns on, the motor 75 rotates, the dehydrating drive mechanism 100 is put in operation, and the brake body 98 disengages from the brake drum 97. The rotary supporter 26 then rotates together with the inner tub 41 around the vertical axis Y-Y at high speed, thus dehydrating the laundry. At step S52 the excess-vibration detecting switch 156 detects whether rotary supporter 26 rotates abnormally. When the abnormal rotation of the rotary supporter 26 is not detected, after at step S53 dehydrating time period has elapsed, step S54 stops the motor 75. At step S55, the intermediate-tub position sensor 153 detects the magnet 152 on the balancer 27, and the rotary supporter 26 is stopped at the predetermined position according to the routine described later. At step S56 the inner tub 41 is stopped at the predetermined position according to the described routine. Subsequently, the process goes to the next. On the other hand, when the excessive-vibration detecting switch 156 detects the abnormal rotation of the rotary supporter 26, step S57 stops the motor 75 and step S58 stops the rotary supporter 26 at the predetermined position according to the described routine. Subsequently, at step S59 the solenoid 124 turns off, the inner-tub rotating drive mechanism 99 is constructed, and the brake body 98 engages the brake drum 97, thereby restraining the rotary supporter 26 from rotating about the vertical axis Y-Y. In addition, the motor 75 rotates forward for about four seconds, stops for about two seconds and then reverses for about four seconds. The inner tub 41 then rotates forward and in reverse to balance the load of the laundry in the inner tub 41, thus eliminating the cause for the abnormal rotation of the rotary supporter 26. Subsequently, step S60 stops the inner tub 41 at the predetermined position according to the described routine. The process goes back to the step S51 for dehydrating the laundry.

ROUTINE FOR STOPPING THE ROTARY SUPPORTER AT THE PREDETERMINED POSITION FOR THE FIRST EMBODIMENT

Figure 19:
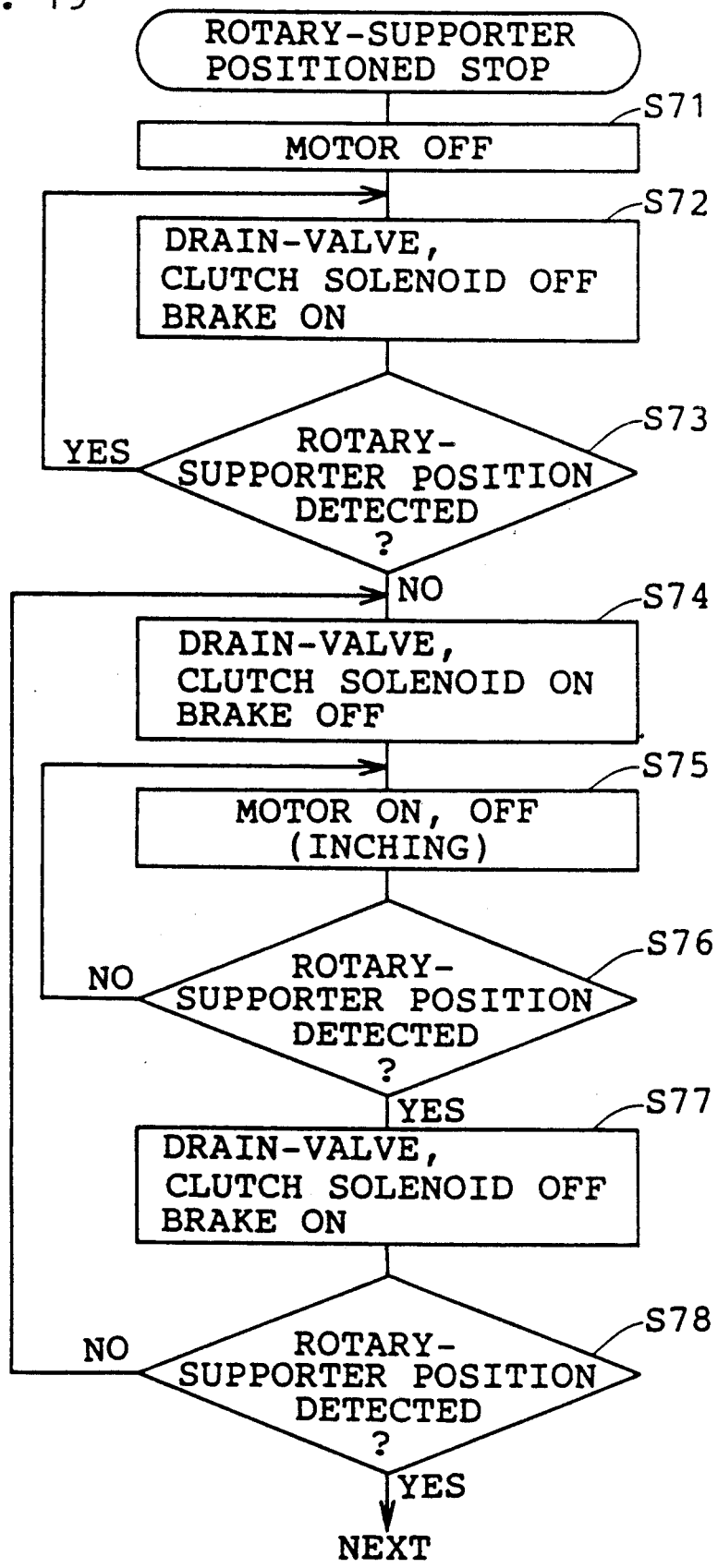

After the laundry is dehydrated as aforementioned, the rotary supporter 26 is stopped at the predetermined position according to the routine shown in the flowchart of FIG. 19.

After the laundry is dehydrated, at step S71 the motor 75 stops. At step S72 after a predetermined time the solenoid 124 turns off, and the brake body 98 engages the brake drum 97, thereby stopping the rotation of the rotary supporter 26. When at step S73 after a predetermined time period the rotary-supporter position sensor 153 issues no detection signal, it is determined that the rotary supporter 26 stops. Subsequently, at step S74, the solenoid 124 turns on and the brake body 98 disengages from the brake drum 97. At step S75, the motor 75 inches forward and the rotary supporter 26 rotates at low speed. When at step S76 the intermediate-tub position sensor 153 issues a detection signal, at step S77 the solenoid 124 turns off and the brake body 98 engages the brake drum 97, thereby stopping the rotation of the rotary supporter 26. When the rotary supporter 26 is stopped, at step S78 the intermediate-tub position sensor 153 sends a detection signal to the CPU 161. When the rotary supporter 26 is stopped at the predetermined position, the process goes to the next routine. When the rotary supporter 26 deviates from the predetermined position, the process goes back to step S74, repeating the routine for stopping the rotary supporter 26 at the predetermined position.

The processes of the machine of the first embodiment produce the following effects.

WASHING PROCESS

To wash the laundry, the inner tub 41 rotates about the horizontal axis X-X. In the inner tub 41, the projections 49 and 61 and the bosses 51 tumble and beat the laundry. The machine of this invention minimizes the amount of water used for washing the laundry and the entanglement of the laundry.

DEHYDRATING PROCESS

When the laundry is dehydrated, the inner tub 41 containing the laundry and the rotary supporter 26 rotate together about the vertical axis Y-Y at high speed without changing their attitudes. The inner-tub 41 is restrained from rotating about the horizontal axis X-X, and rotates together with the rotary supporter 26 in the same direction about the vertical axis Y-Y at the same speed. When the inner tub 41 rotates about the vertical axis Y-Y, centrifugal force is generated. Due to the centrifugal force, the laundry is dispersed in a form of a ring around the maximum inner diameter intersecting the vertical axis Y-Y in the inner-tub 41. At this time, the inner tub 41 is restrained from rotating about the horizontal axis X-X.

In the machine of the first embodiment, even when the center of gravity of the laundry is off the vertical axis Y-Y, the laundry is dispersed uniformly in the inner tub 41.

When the inner tub 41 containing the laundry rotates about the horizontal axis X-X and the rotary supporter 26 rotates about the vertical axis Y-Y, the load of the laundry in the inner tub 41 becomes unbalanced. The centrifugal force resulting from the rotation of the inner-tub 41 is exerted on the center of gravity of the laundry, thus unbalancing the load of the laundry and causing vibration and noise. At the time of the starting of dehydration, when the center of gravity of the laundry is off the vertical axis Y-Y, the inner-tub 41 rotates about the horizontal axis X-X. The inner-tub 41 rotates in the direction where the laundry is eccentric. The inner-tub 41 can repeat its rotation until the laundry reaches the horizontal plane including the horizontal axis X-X.

The load of the laundry becomes unbalanced for the following reasons.

First, when the laundry is dispersed around the vertical axis Y-Y in the inner tub 41, frictional force is generated. When the frictional force is not uniform, the unbalanced load occurs. When the laundry is dispersed due to the centrifugal force, the laundry requires the frictional force to detach from the inner surface of the inner tub 41.

Secondly, when the center of gravity of the laundry deviates from the vertical axis Y-Y, the unbalanced load occurs.

To prevent unbalance in the load from occurring, the machine of the first embodiment restrains the inner tub 41 from rotating about the horizontal axis X-X when the laundry is dehydrated. In the machine of the first embodiment, vibration and noise resulting from the dehydrating process are suppressed. The suspenders 16 absorb the vibration of the outer tub 15 caused by the dehydrating process and the high-speed rotation. The vibration of the outer tub 15 is prevented from being transmitted to the housing 1. Since the upper and lower engaging portions 18 and 19 of the suspenders 16 vibrate at their engaging portions, the vibration of the outer tub 15 is minimized. The springs 20 of the suspenders 16 also reduce the vibration of the outer tub 15.

When the inner tub 41 rotates, the moment of inertia is caused due to the mass of the rotating balancer 27. The moment of inertia reduces the unbalance in the load due to the eccentric center of gravity of the laundry in the inner tub 41. Since the inner tub 41 is supported by the bearings 43 of the rotary supporter 26, the moment of inertia is generated on the horizontal plane including the horizontal axis X-X due to the mass of the inner tub 41 when the inner tub 41 rotates. The moments of inertia caused by the balancer 27 and the inner tub 41 are exerted on the rotary supporter 26. The unbalance in the load of the laundry is thus reduced and the vibration of the outer tub 15 is suppressed.

RINSING PROCESS

When the laundry is rinsed, the inner tub 41 rotates around the horizontal axis X-X. Water is supplied through the first water outlet 115 to the outer periphery of the inner tub 41 and through the second water outlet 118 to the inside of the inner tub 41. Bubbles are effectively flushed away from the outer periphery of the inner tub 41.

DRYING PROCESS

When the laundry is dried, the inner tub 41 rotates about the horizontal axis X-X. In the inner tub 41, the laundry is agitated. At the same time, warm air is supplied to the inner tub 41. The laundry is less entangled in the machine of this embodiment during the washing, dehydrating and rinsing processes. Therefore, the laundry is uniformly exposed to warm air and effectively dried. The bellows 23 renders the inside of the outer tub 15 airtight, thus preventing hot and humid air from leaking outside the outer tub 15. The bellows 143 absorbs the vibration of the outer tub 15 during the drying process. Consequently, warm air can be supplied without problem.

POSITIONED STOP OF THE INNER TUB AND THE INNER-TUB HOLDER

When the lid 56 is aligned with the opening 22 in the cover 21, the inner tub 41 is stopped, thereby facilitating the loading and unloading of the laundry.

When the bearings 36 of the rotary supporter 26 and the cylindrical members 43 of the inner tub 41 are aligned with the air outlet 144 of the outer tub 15, the rotary supporter 26 is stopped. Consequently, the laundry is effectively dried when warm air is smoothly supplied.

DESCRIPTION OF THE SECOND EMBODIMENT

Figure 20:
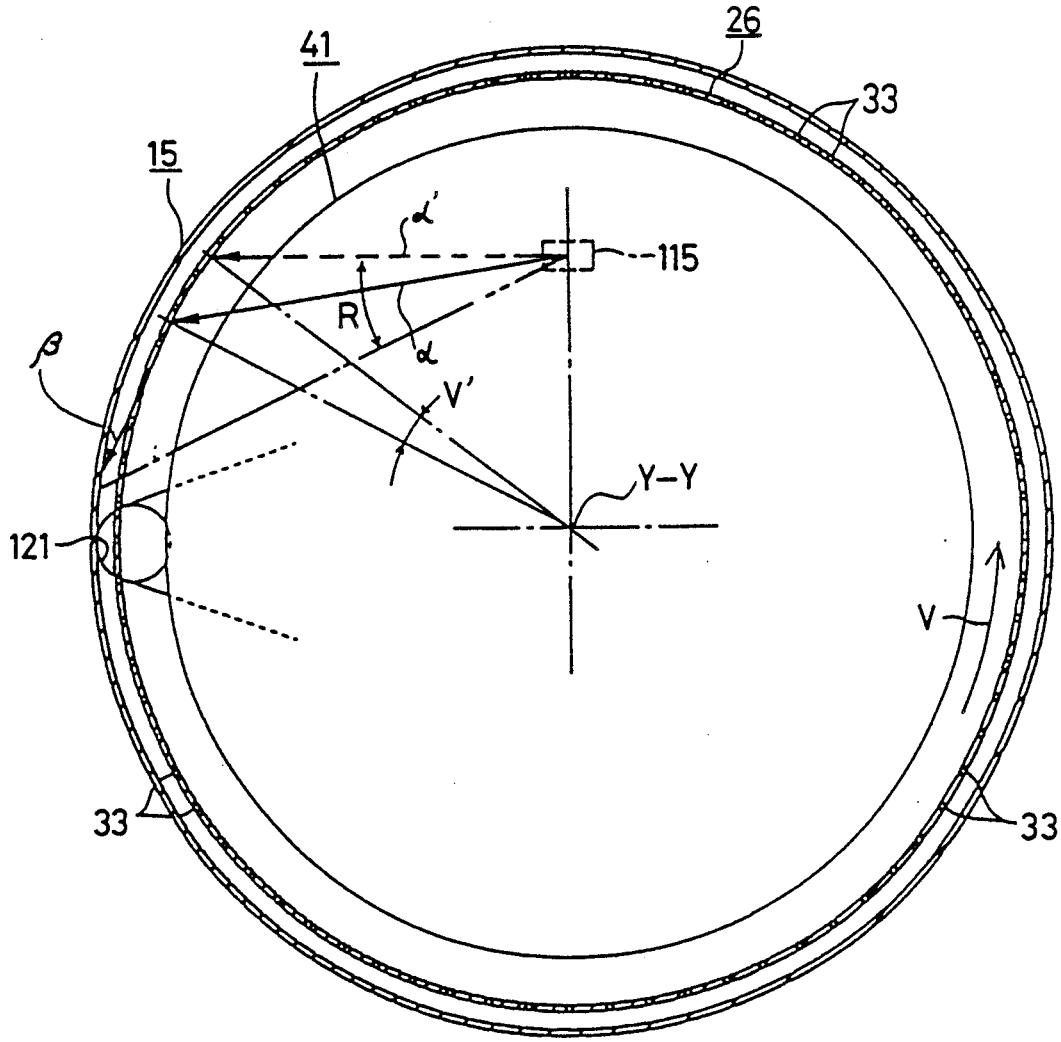
FIGS. 20 through 22 show a second embodiment of this invention.
Figure 21:
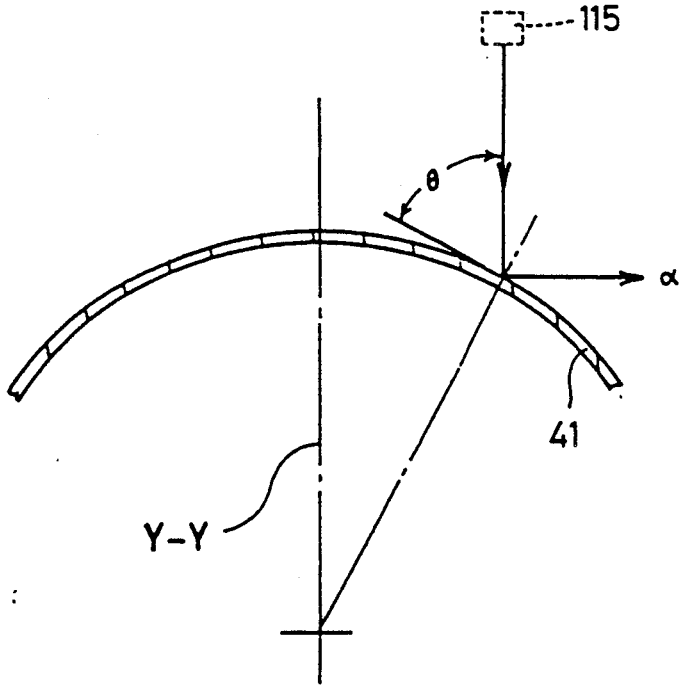
Figure 22:
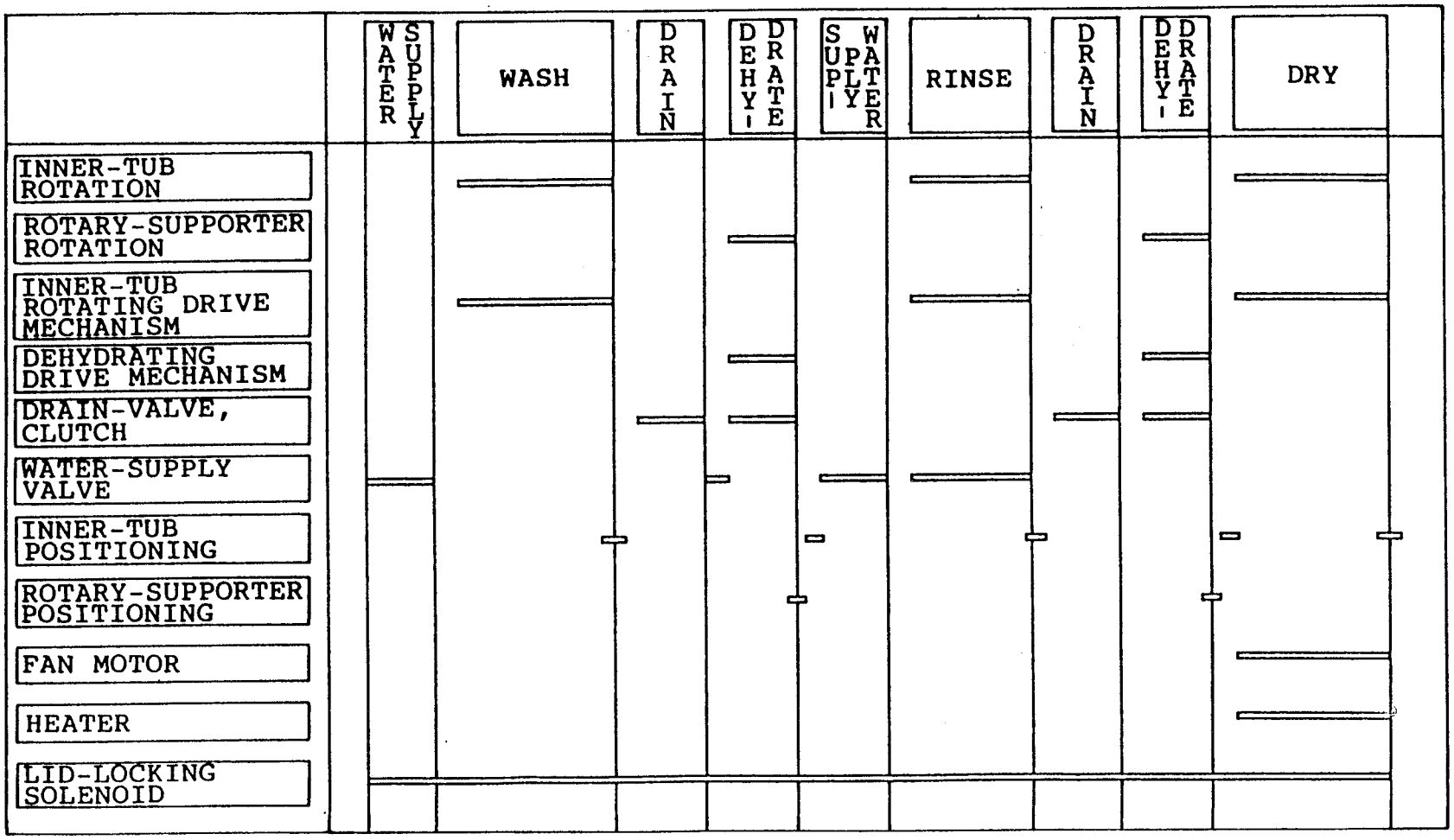

Next, the washing and dehydrating machine of the second embodiment is described with reference to FIGS. 20 through 22. Members different from the washing and dehydrating machine of the first embodiment are mainly explained in detail. Identical members to those of the first embodiment are given identical numbers.

The washing and dehydrating machine of the second embodiment, which is modified from the first washing and dehydrating machine, can promptly and easily wash away bubbles of detergent generated during washing.

The first water outlet 115 opposite to the outer periphery of the inner tub 41 is arranged beside the vertical rotation axis of the rotary supporter 26 and not parallel to the radial slit from the center of the spherical inner tub 41. After the laundry is washed, the rotary supporter 26 and the inner tub 41 rotate together about the vertical rotation axis Y-Y to dehydrate the laundry. The process is called process (d), as shown in FIG. 22. Water from the first water outlet 115 runs against the outer surface of the inner tub 41 and is dispersed in the inner surface of the rotary supporter 26 at an angle shown in FIGS. 20 and 21. Then the water flowing through the multiple pores 33 of the rotary supporter 26 is scattered in the inner surface of the outer tub due to the centrifugal force caused by the rotation of the rotary supporter 26. As shown in FIG. 20 the drain outlet 121 is positioned ahead of the first water outlet 115 in the rotation direction V of the rotary supporter 26. Thus the bubbles between the inner surface of the outer tub 15 and the outer surface of the inner tub 41 is promptly and effectively pushed out to the drain outlet 121 owing to the rotation of the rotary supporter 26 after the laundry is washed. Furthermore the rotation of the rotary supporter 26 is not prevented by the bubbles, thus the laundry being dehydrated smoothly.

DESCRIPTION OF THE THIRD EMBODIMENT

Figure 24:
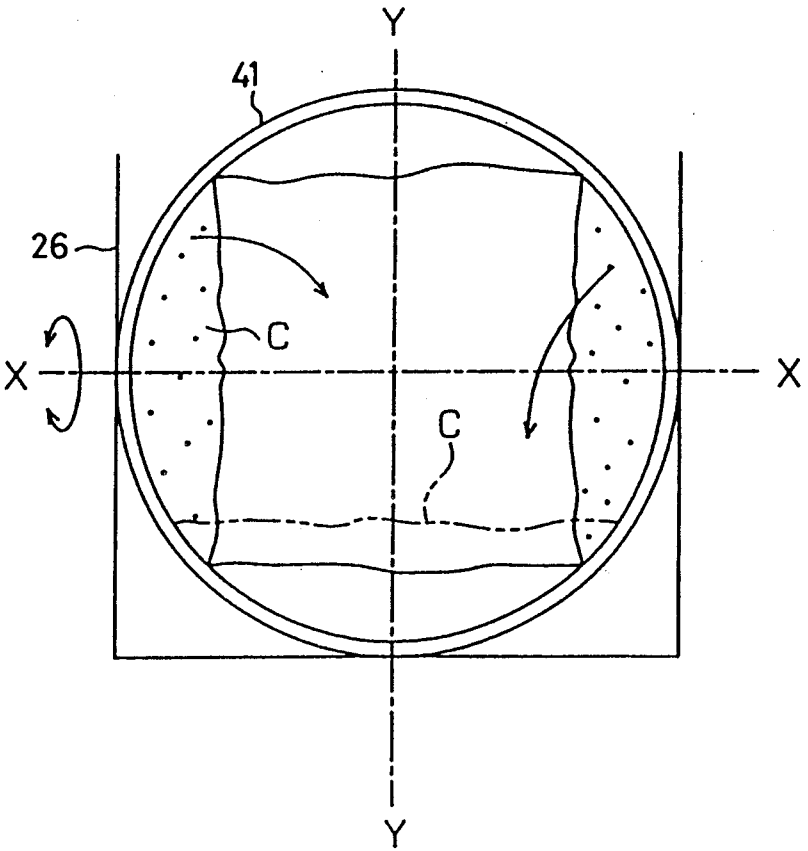
FIGS. 23 through 25 show a third embodiment of this invention.
Figure 23:
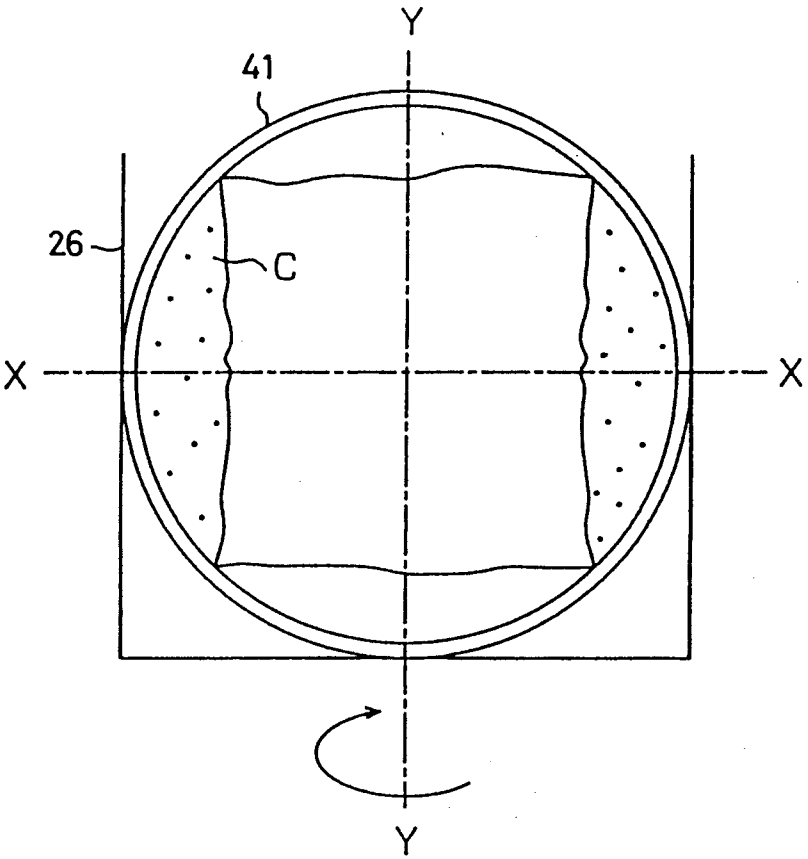

The washing and dehydrating machine of the third embodiment is described with reference to the FIGS. 23 through 25. Members different from the washing and dehydrating machines of the first and the second embodiments are mainly explained in detail. Identical members to those of these two embodiments are given the identical reference numbers.

The washing and dehydrating machine, which is modified from the first washing and dehydrating machine, can uniformly and effectively dehydrate laundry.

Figure 25:
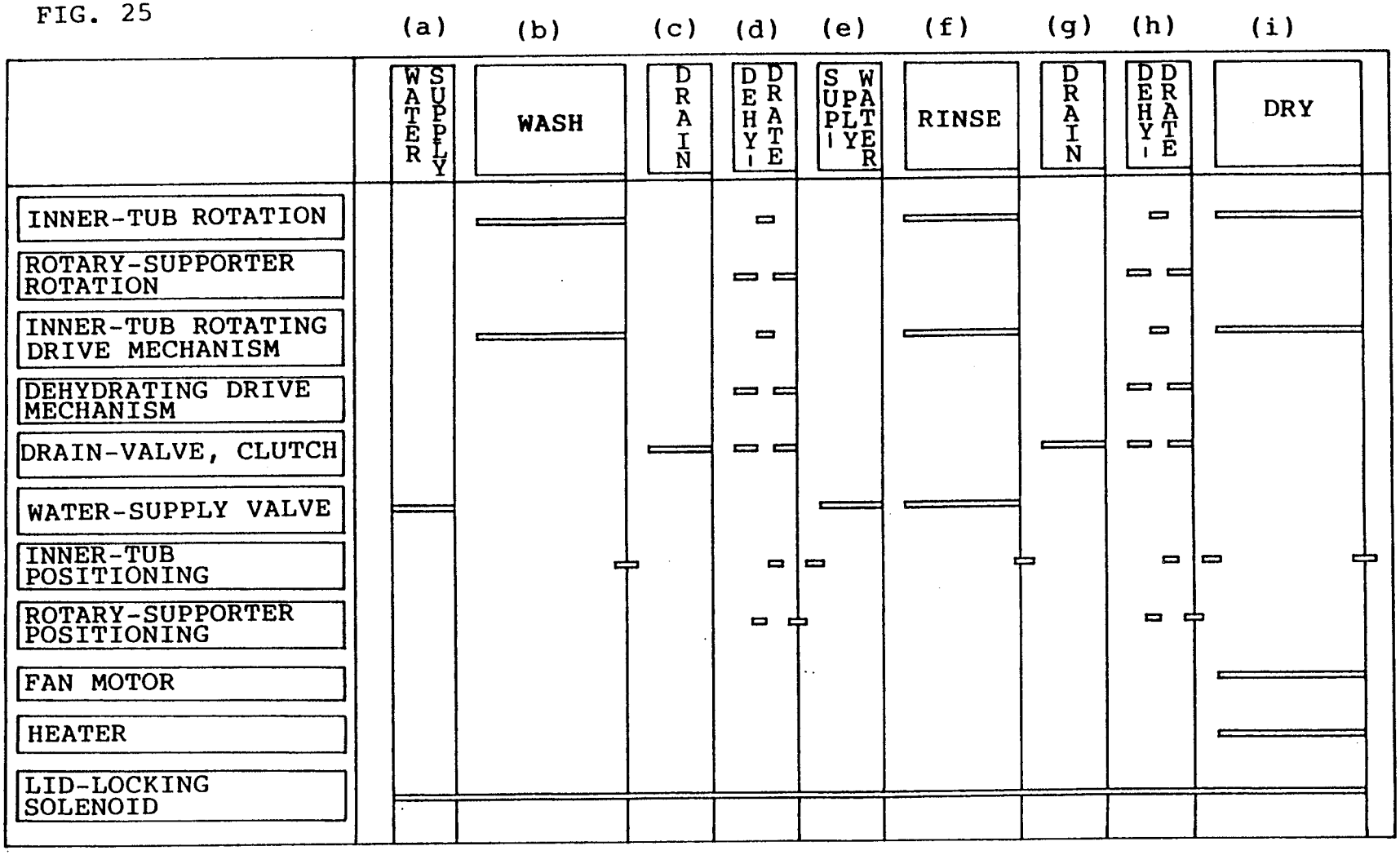
Figure 26:
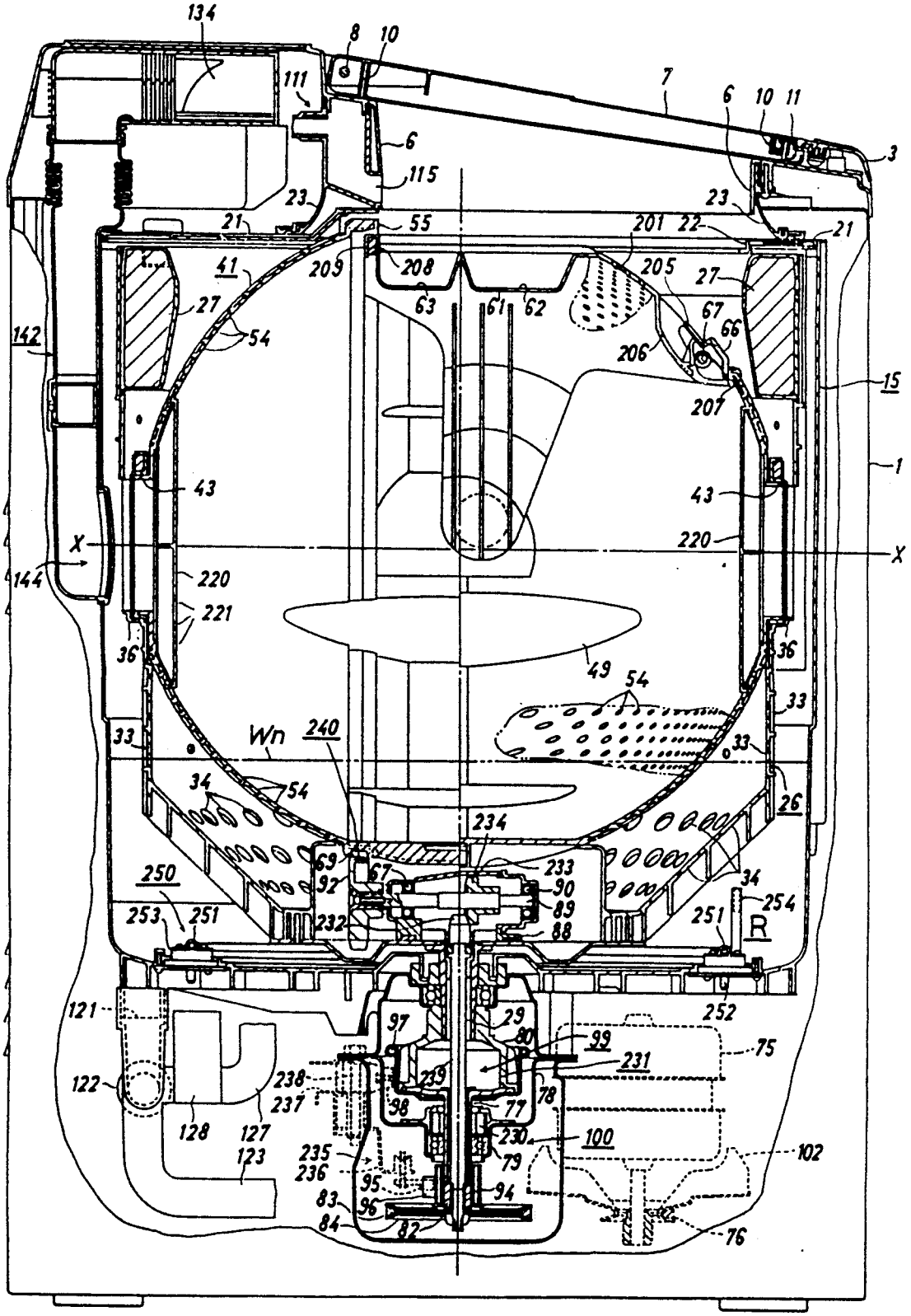
FIGS. 26 through 35 show a fourth embodiment of this invention.
Figure 27:
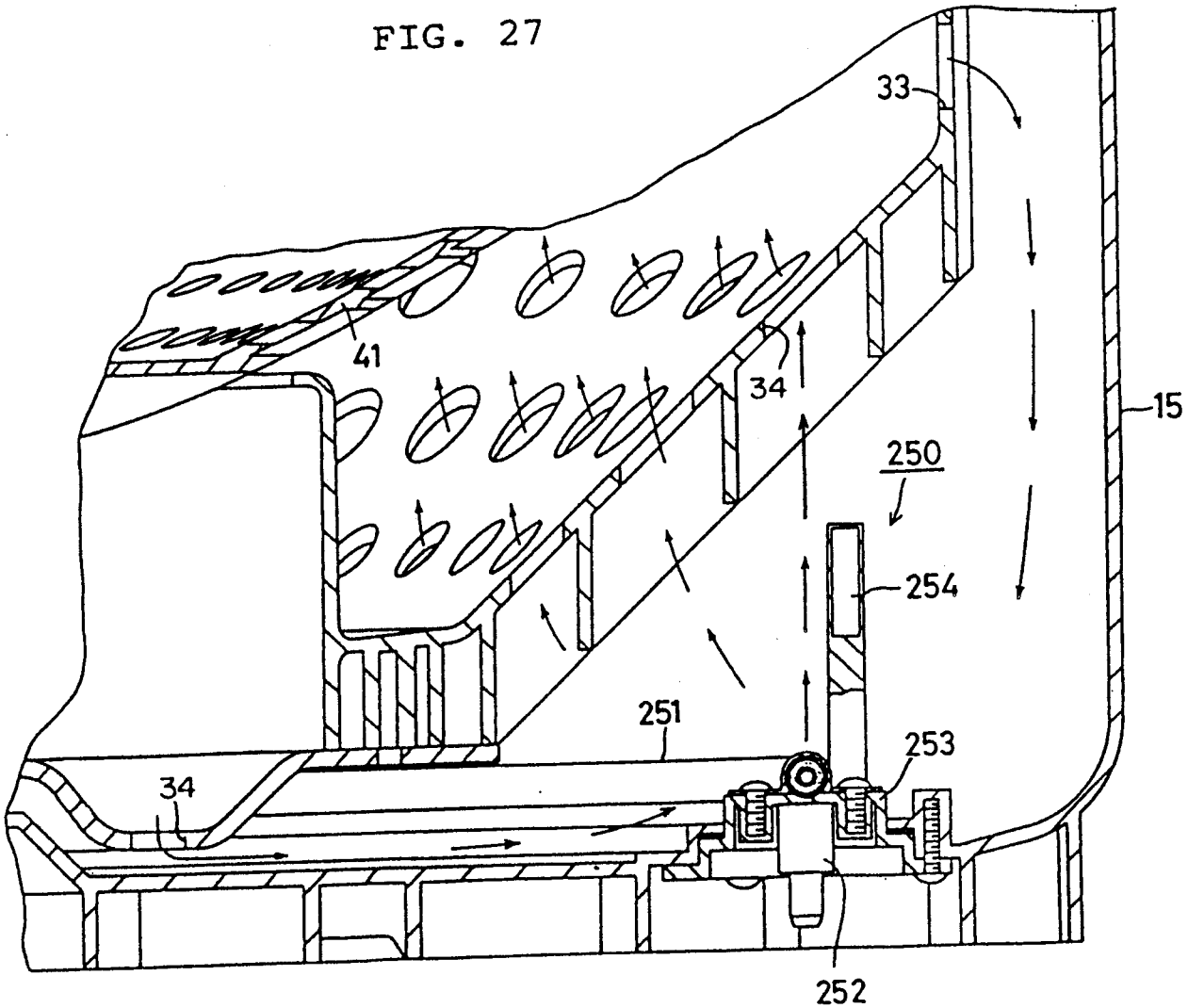
Figure 28:
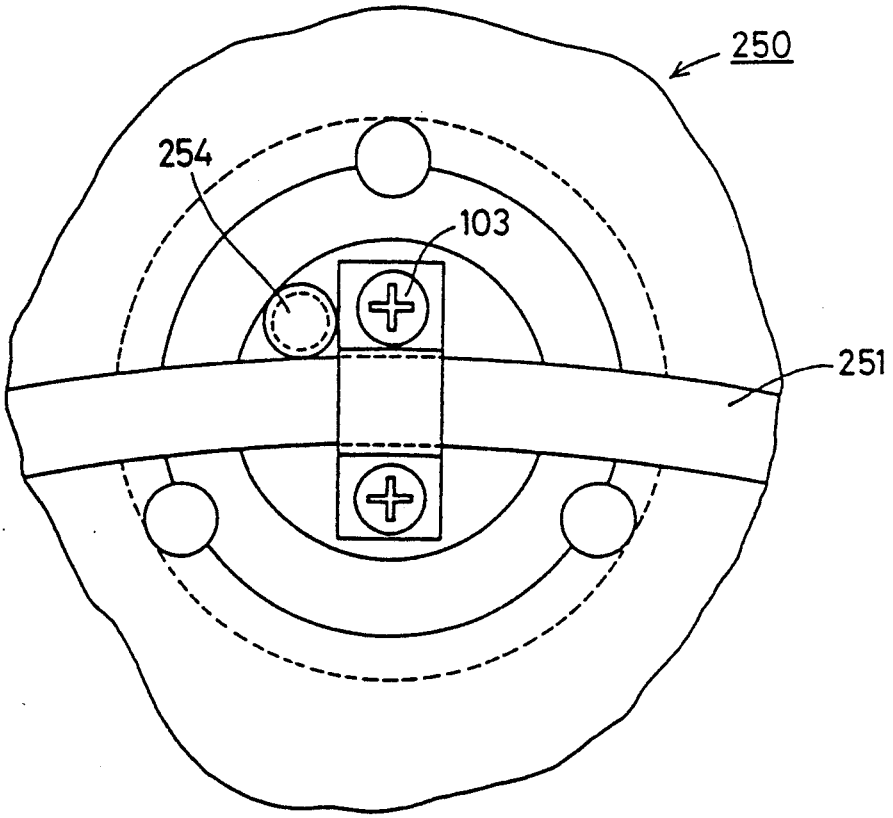
Figure 29:
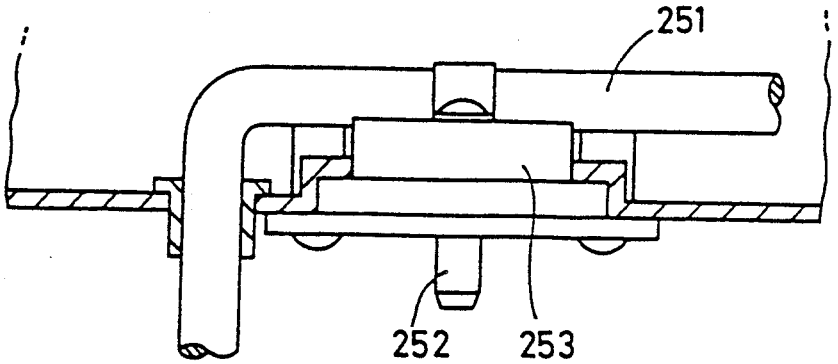
Figure 30:
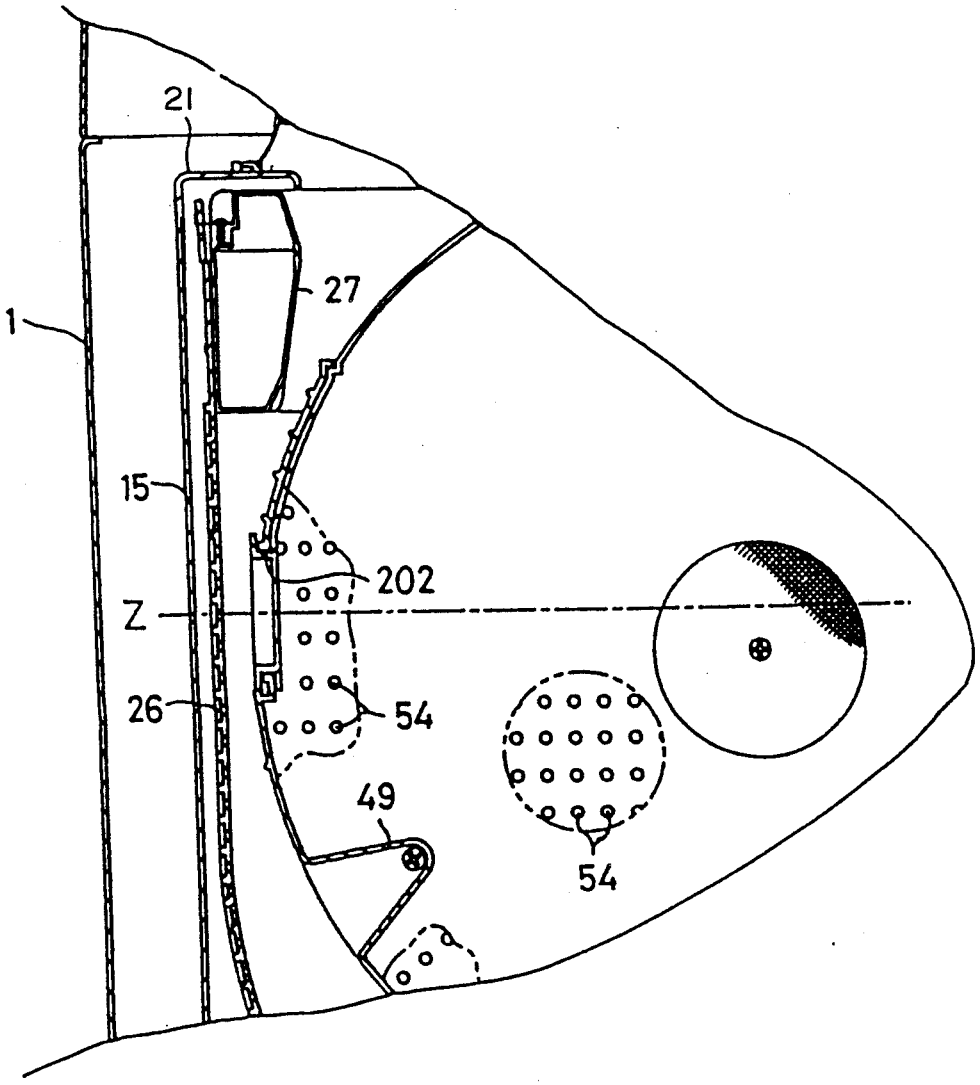
Figure 31:
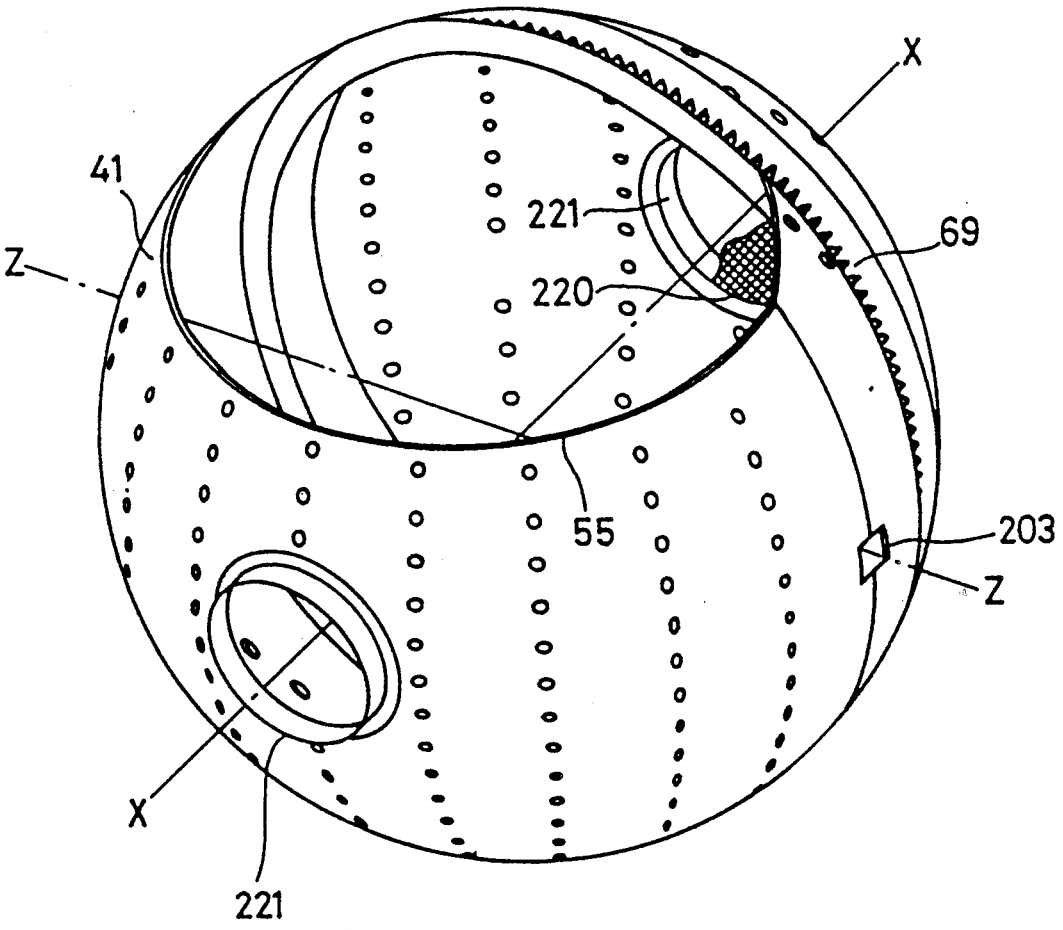
Figure 32:
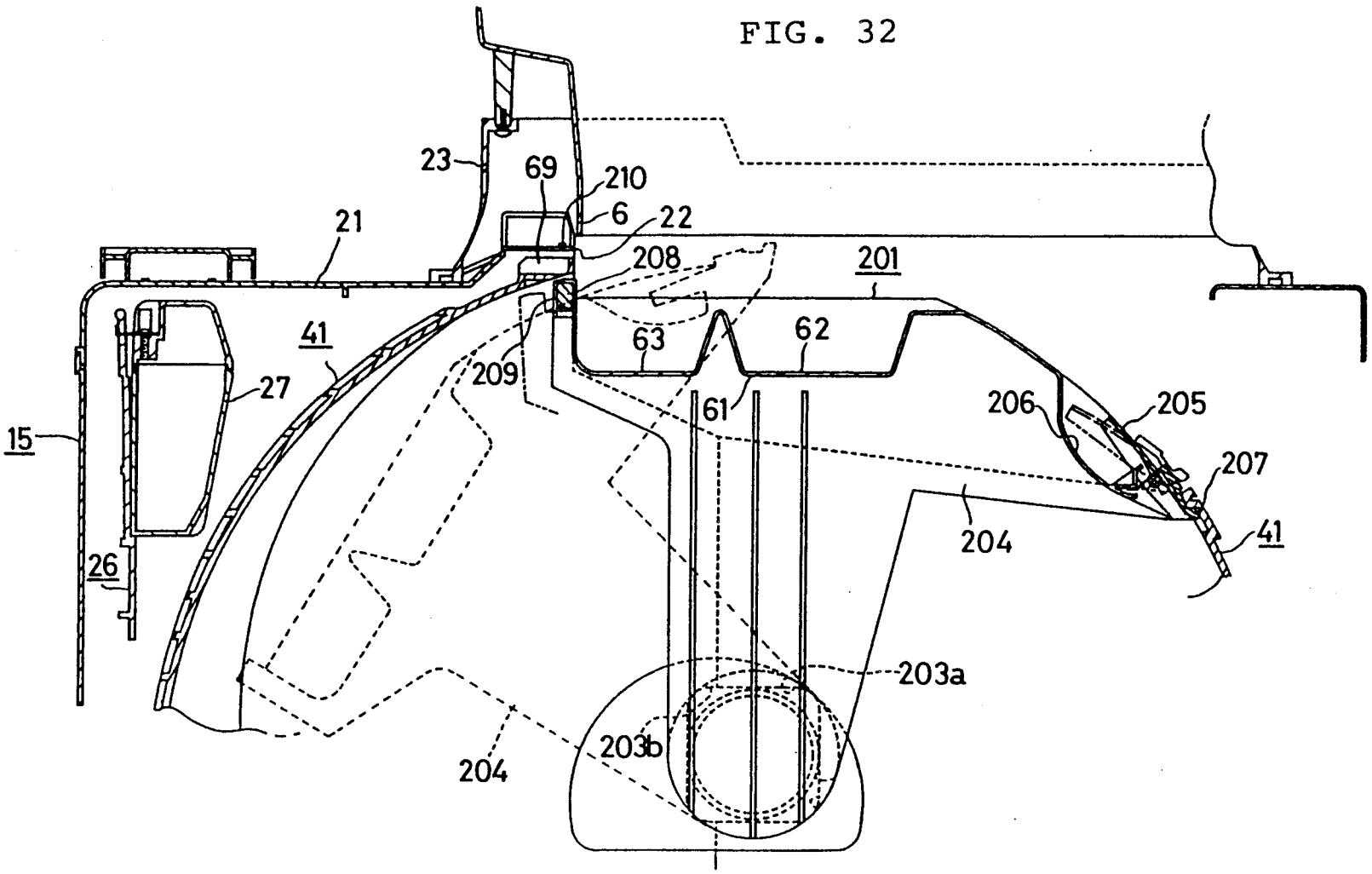
Figure 33:
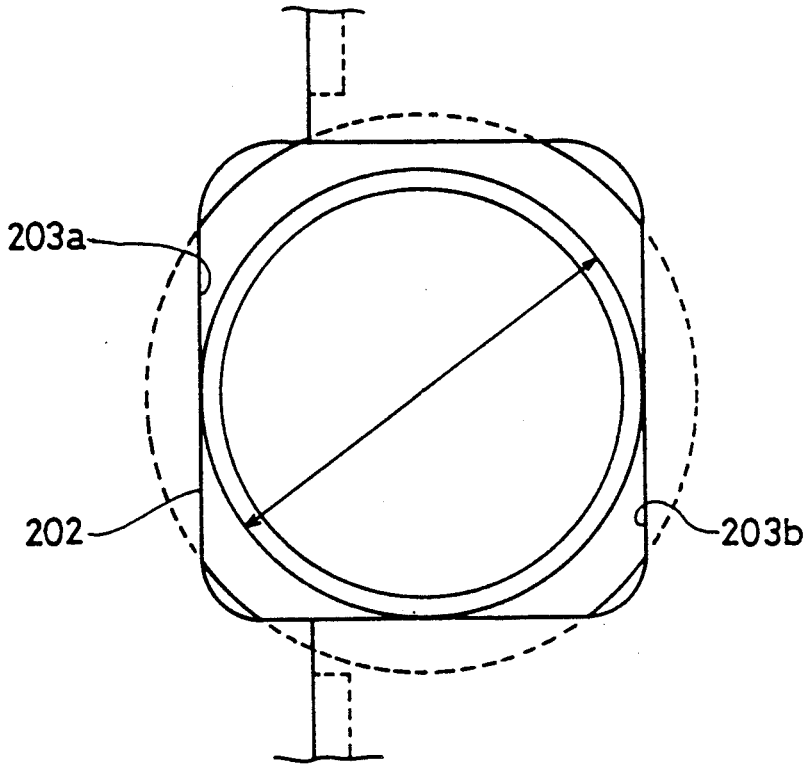
Figure 34:
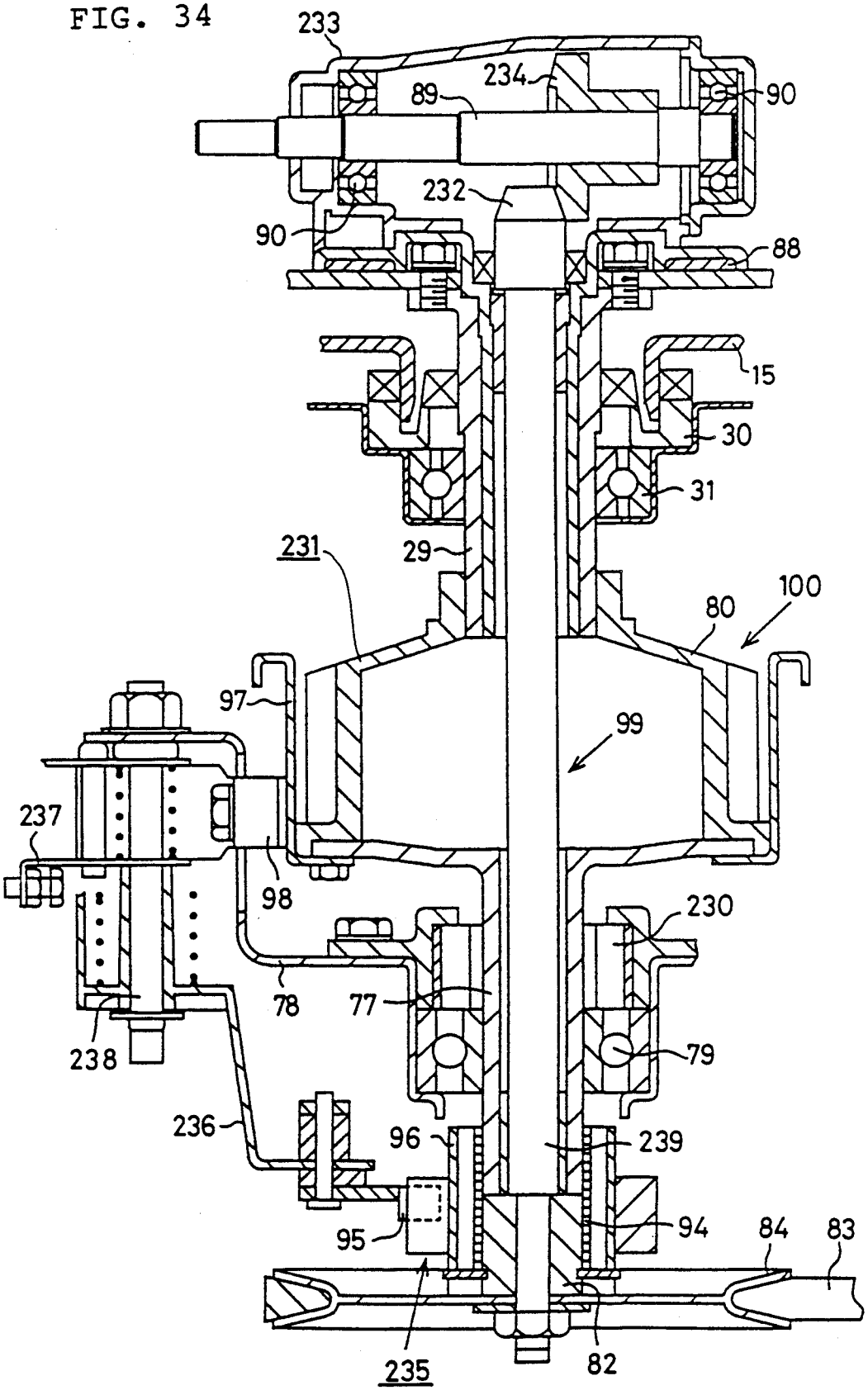

As shown in FIG. 25, in the middle of the dehydrating processes (d) and (h) after the washing and rising operations respectively, the rotary supporter 26 and inner tub 41 rotated about the vertical axis Y-Y by the dehydrating drive mechanism 100 are stopped rotating. Then the inner tub 41 is rotated about the horizontal axis X-X by the inner-tub rotation drive mechanism 99 for specified time (about 30 seconds). After that, the inner tub 41 and the rotary supporter 26 are rotated together by the dehydrating drive mechanism 100 again. As shown in FIGS. 23 and 24, the laundry C dispersed around the inner surface of the inner tub 41 like a ring due to the centrifugal force is stirred when the inner tub 41 rotates around the horizontal axis X-X. Consequently, the laundry is mingled and dehydrated effectively when the dehydrating operation recommences.

DESCRIPTION OF THE FOURTH EMBODIMENT

Finally the washing and dehydrating machine of the fourth embodiment is described referring to the FIGS. 26 through 35. Members different from the washing and dehydrating machines of the first, the second and the third embodiments are mainly explained in detail. Identical members to those of these three embodiments are given the identical reference numbers of these embodiments.

CONSTRUCTION OF THE INNER TUB FOR THE FOURTH EMBODIMENT

A synthetic resin lid 201 is installed in the inner tub 41 and can rotate on the axis Z-Z. A pair of cylindrical members 202 is supported by a pair of bearings 203 comprising re-entrants 203*a* and 203*b* formed in the inner tub 41. The lid 201 for opening and closing the opening 55 is equipped with an opening and closing member 204 which engages with the inner surface of the opening 55 when the lid 201 is closed. When a hook 205 provided in a recess 206 of the lid 201 abuts with a click 207 in the periphery of the opening 55, the lid 201 closes the opening 55.

A magnet 208 as a detected body is inserted and fixed to an accommodation part 209 in the lid 201. A sensor 210 as a detect body is positioned on the outer-tub cover 21 opposite to the magnet 208. The sensor 210 detects the magnet 208 when the lid 201 is closed and does not detect the magnet 208 when the lid 201 is opened even slightly. The sensor 210 also confirms that the inner tub 41 stops at a specified position.

DRIVE MECHANISM OF THE INNER TUB AND THE ROTARY SUPPORTER FOR THE FOURTH EMBODIMENT

The motor 75 for rotating the inner tub 41 and the rotary supporter 26 can rotate both forward and in reverse. The driving pulley 76 to which the motor cooling fan is attached is driven by the motor 75. The lower hollow shaft 77 is vertically aligned with the upper hollow shaft 29 and is connected to the upper hollow shaft 29 via the support member 78, the bearing 79, the clutch 230, and the gear housing 80. A rotary-supporter drive shaft 231 comprises the upper hollow shaft 29, the lower hollow shaft 77 and the gear housing 80. A rotating drive shaft 239 is supported in the rotary-supporter drive shaft 231 via a metal and rotates relative to the rotary-supporter drive shaft 231. On the lower end of the rotating drive shaft 239 the driven pulley 84 connected to the driving pulley 76 via the belt 83 is provided. On the upper end of the rotation drive shaft 239 is a pinion 232. When rotated the pinion 232 drives a hypoid gear mechanism. A synthetic resin gear cover 233 is installed watertight on the support member 78 at the bottom of the rotary supporter 26 via a packing 88. The non-driven rotating shaft 89 is rotatably supported by the bearing 90 in the gear cover 233. A hypoid gear 234 engaging with the pinion 232 is fixed at one end of the non-driven rotating shaft 89. At the other end of the non-driven rotating shaft 89 the driven gear 92 is fixed. At the bottom of the inner tub 41 the driven gear 92 engages with the non-driven gear 69 and the two gears 69 and 92 compose a transmission mechanism 240.

Figure 35:
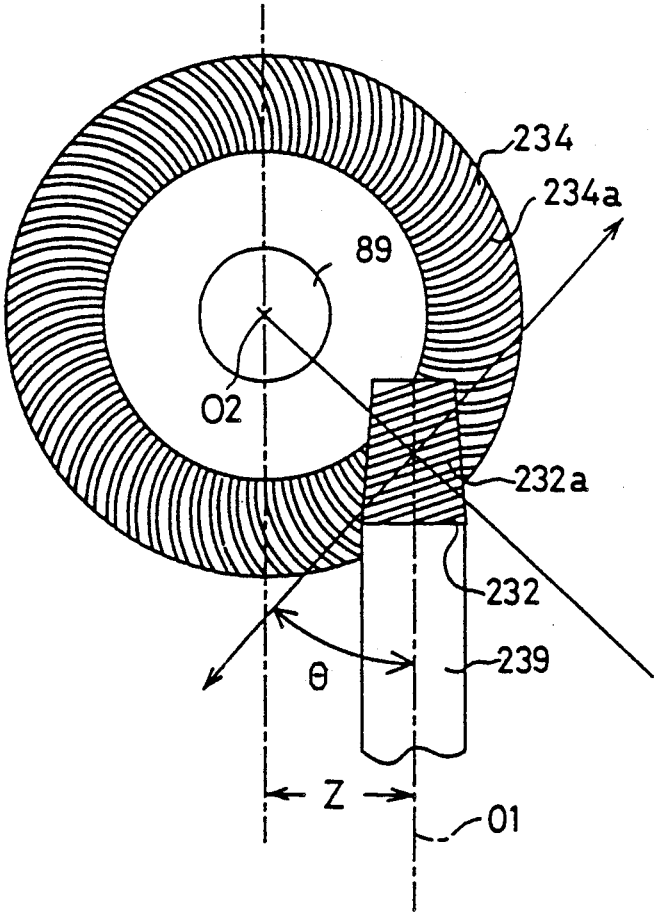

As shown in FIG. 35 the hypoid gear 234 has helical hypoid teeth 234 *a* on a surface that contains a rotation axis 01 of the rotating drive shaft 239 and is orthogonal to a rotation axis 02 of the non-driven rotating shaft 89. The hypoid teeth 234 *a* are formed on the tapered surface of the hypoid gear 234. Spiral pinion teeth 232*a* are formed on the tapered end of the rotating drive shaft 239. Since the rotation axis 02 is positioned apart from the rotation axis 01 by a specified distance Z, the hypoid gear mechanism can attain high deceleration ratio. Transfer torque is generated from the side of the pinion 232 in the direction inclined degree $\theta$ to the rotation axis 01 of the pinion 232. Consequently, in the hypoid gear mechanism rotation is transmitted only from the pinion gear 234. Specifically the pinion 232 is not rotated by the force from the inner tub 41. Thus the hypoid gear mechanism comprising the hypoid gear 234 and the pinion 232 is irreversible.

The spring clutch 94 is put around the outer surface of the clutch coupling 82. When the clutch click 95 disengages from the clutch housing 96 the rotating drive shaft 239 and the lower hollow shaft 77 are rotated altogether via the spring clutch 94. When the clutch click 95 engages with the clutch housing 96 the rotating drive shaft 239 and the lower hollow shaft 77 are detached. A change mechanism 235 comprises the spring clutch 94, clutch click 95 and a clutch lever 236. A clutch lever 236 is rotatably supported on a supporting shaft 238 of the support member 78. On the upper part of the lever 237 the brake body 98 is provided. When the brake body 98 is pressed to the brake drum 97 fixed on the outer periphery of the gear housing 80, the rotary supporter 28 is controlled together with the upper and the lower hollow shafts 29 and 77 and the gear housing 80. When the spring clutch 94 of the change mechanism 235 disengages and the brake body 98 is controlled, the inner tub 41 is rotated around the horizontal axis X-X. On the contrary, when the spring clutch 94 engages with the clutch housing 96 and the brake body 98 is not controlled, the rotary supporter 26 is rotated around the vertical axis Y-Y. The rotating shaft 239 is rotated together with the rotary-supporter drive shaft 231 at the same speed in the same direction. The inner tub 41 is rotated together with the rotary supporter 26 around the vertical axis Y-Y without being rotated around the horizontal axis X-X.

The inner-tub rotation drive mechanism 99 rotates the inner tub 41 around the horizontal axis X-X to wash, rinse and dry the laundry. The dehydrating drive mechanism 100 rotates the inner tub 41 and the rotary supporter 26 around the vertical axis Y-Y to dehydrate the laundry.

The rotation drive mechanism comprises the motor 75, the driving pulley 76, the belt 83, the driven pulley 84, the rotating drive shaft 239 and the clutch coupling 82.

The inner-tub rotation mechanism comprises the pinion 232, the hypoid gear 234, the non-driven rotating shaft 89, the driven gear 92 and the non-driven gear 69.

MECHANISM FOR HEATING THE WATER FOR THE FOURTH EMBODIMENT

A water heating device 250 for heating the water in the outer tub 15 and the inner tub 41 comprises a circular heater 251. The heater 251 is provided around the vertical axis Y-Y between the bottom surface of the outer tub 15 and that of the inner tub 41. The heater 251 is fixed on several mounts 253 on the bottom of the outer tub 15 and both ends of the heater 251 are connected to a power source in the outside penetrating through the outer tub 15. Temperature fuses 252 attached to the inner surface of the mounts 253 stops electric current to the heater 251 when the heater 251 is excessively heated. A thermister 254 in a cylinder in the mount 253 detects the temperature of the water.

OPERATION OF THE INNER TUB FOR THE FOURTH EMBODIMENT

Washing, dehydrating, rinsing and drying operations of the present washing and dehydrating machine is explained. After the laundry is loaded in the inner tub 41 through the opening 55, the lid 201 is closed and locked via the hook 205. The detergent is accommodated in the dispensers 62 and 63. The drain valve 122 is closed and the spring clutch 94 disengages from the clutch housing 96. When the water supplied through the first water outlet 115 reaches the normal water level Wn in the outer tub 15 and the inner tub 201, the motor 75 drives the inner-tub rotation drive mechanism 99 to wash the laundry. The detergent in the dispensers 62 and 63 is dissolved in the water in the bottom of the outer tub 15 as the inner tub 41 rotates.

The laundry is tumbled and beaten by the projections 49 and 61 in the inner tub 41 when the inner tub 41 rotates around the horizontal axis X-X both forward and in reverse. A pair of cover boards 220 cover the openings of the front and rear cylindrical members 43. The laundry near the front and read ends moves up and down more widely when the cover boards 220 are provided than when there are no cover boards.

While the laundry is rinsed after the washing process, water is supplied through the first water outlet 115 to the upper outer surface of the inner tub 41 and also is drained through the overflow water outlet 125. Thus the water level is kept at a fixed level. The inner tub 41 rotates about the horizontal axis X-X to rinse the laundry.

After the laundry is rinsed, the drain valve 122 is opened, the spring clutch 94 engages, and the brake body 98 disengages. Then the dehydrating drive mechanism 100 works. The motor 75 rotates both the rotary supporter 26 and inner tub 41 about the vertical axis Y-Y at the same speed and in the same direction to dehydrate the laundry. The inner tub 41 does not rotates about the horizontal axis X-X.

OPERATION AND EFFECTS OF THE LID OF THE INNER TUB FOR THE FOURTH EMBODIMENT

The lid 201 of the inner tub 41 rotates around the lid rotation axis Z-Z by means of the hook 205, thus opening and closing the opening 55 of the inner tub 41. After the laundry is loaded through the opening 55, the periphery of the lid 201 securely engages with the inner surface of the inner tub 41. The lid 201 is strong enough to withstand the weight of the fallen laundry.

The sensor 210 detects the magnet 208 and sends a signal, when the lid 201 is properly closed. On the other hand, the sensor 210 does not detect the magnet 208 when the lid 201 is not closed. Only when the sensor 201 outputs the signal, the washing, dehydrating, rinsing and drying operations can start. The sensor 210 can also confirm that the inner tub 41 stops at an appropriate position. The laundry is not faded by the detergent because it is washed by the detergent dissolved in the water.

OPERATION AND EFFECTS OF THE DRIVE MECHANISMS OF THE INNER TUB AND THE ROTARY SUPPORTER FOR THE FOURTH EMBODIMENT

The inner-tub rotation drive mechanism 99 including the hypoid gear 234 rotates the inner tub 41 about the horizontal axis X-X without rotating the rotary supporter 26 about the vertical axis Y-Y. The dehydrating drive mechanism including the spring clutch 94 rotates the rotary supporter 26 about the vertical axis Y-Y.

Like in the washing and dehydrating machine of the first embodiment, in the washing and dehydrating machine of the present embodiment the inner tub 41 rotates both about the horizontal axis X-X and the vertical axis Y-Y without changing the attitude of the inner tub 41. Specifically, the inner tub rotation drive mechanism 99 rotates only the inner tub 41 about the horizontal axis X-X to wash, rinse and dry the laundry, and the dehydrating drive mechanism 100 rotates both the inner tub 41 and the rotary supporter 26 about the vertical axis Y-Y to dehydrate the laundry. In addition, the rotation of the rotation drive shaft 239 is transmitted to the inner tub 41 via the hypoid gear 234 and the pinion gear 232, which compose the irreversible transmission. Therefore the rotation of the inner tub 41 is not transmitted to the motor 75 and the inner tub 41 stops at a specified position after each operation.

OPERATION AND EFFECTS FOR HEATING THE WATER FOR THE FOURTH EMBODIMENT

Water is heated up to a suitable temperature (for example, 60° C.) by the heater 251 before the laundry is washed. Since the inner tub 41 rotates forward and in reverse about the horizontal axis X-X, the heated water is mixed with the cold water and the temperature becomes uniform. When the thermister 254 detects the suitable temperature, a signal for stopping electric current to the heater 251 is output.

What is claimed is:

1. A machine for washing and removing liquid from laundry, comprising:

an outer tub for containing liquid;

a liquid supply and drain means for supplying liquid to and draining liquid out of the outer tub;

a rotation-support member rotatable about a vertical axis in the outer tub;

an inner tub, having a plurality of pores in its periphery and being rotatably supported about a horizontal axis by the rotation-support member, for containing the laundry;

a rotation drive means including a motor;

an inner tub rotating means, which is provided between the rotation drive means and the inner tub, that attaches the rotation drive means to the inner tub and has a decelerating means for rotating the inner tub at a first speed;

a rotation-support member rotating means for attaching the rotation-support member to the rotation drive means and for transmitting a turning force to the rotation support member; and a switching means provided on the rotation-support member rotating means for connecting and disconnecting the rotation-support member rotating means with and from the rotation drive means;

wherein:

the switching means provides for driving of the inner tub rotating means by the rotation drive means and stopping of the rotation of the rotation-support member, so as to rotate the inner tub only about the horizontal axis at the first speed when the rotation-support member rotating means is disconnected from the rotation drive means, and provides for driving of the rotation-support member rotating means together with the inner tub rotating means so as to rotate the rotation-support member and the inner tub about the vertical axis at a second speed, which is greater than the first speed, in the same direction, so as to stop the rotation of the inner tub about the horizontal axis relative to the rotation-support member, when the rotation-support member rotating means is attached to the rotation drive means;

and wherein:

the liquid supply and drain means supplies liquid to the outer tub such that the liquid reaches a predetermined level inside the inner tub, and the switching means provides for rotation of the inner tub only about the horizontal axis at the first speed for washing and rinsing the laundry in the inner tub by detaching the rotation-support member rotating means from the rotation drive means, and provides for rotation of the inner tub and the rotation-support member about the vertical axis at the second speed for removing liquid from the washed and rinsed laundry by attaching the rotation-support member rotating means to the rotation drive means after the outer tub is drained by the liquid supply and drain means.

2. A machine for washing and removing water from laundry, comprising:

an outer tub for containing water;

a water supply and drain means for supplying water to and draining water out of the outer tub;

a rotation-support member rotatably supported about a vertical axis in the outer tub;

an inner tub, having multiple pores in its periphery and being rotatably supported about a horizontal axis by the rotation-support member, for containing the laundry;

an inner-tub rotating means for rotating the inner tub;

a rotation drive means comprising a drive motor that is always connected to the inner-tub rotating means for driving the inner-tub rotating means; and a rotation-support member rotating means detachably attached to the rotating drive means;

wherein:

The rotation-support member rotating means controls the rotation of the rotation support member and allows the inner tub to rotate about the horizontal axis when the rotation-support member rotating means is detached from the rotation drive means;

the rotation-support member rotating means rotates the rotation-support member and the inner tub at the same speed in the same direction about the vertical axis and controls the rotation of the inner tub relative to the rotation-support member when the rotation-support member rotating means is connected to the rotation drive means;

the machine washes and rinses the laundry by rotating the inner tub about the horizontal axis when the water supply and drain means supplies water into the outer tub so that water reaches a predetermined level inside the inner tub, the inner tub is loaded with laundry, and the rotation-support member rotating means is detached from the rotation drive means; and the machine removes water from the laundry, after washing and rinsing the laundry in the inner tub, by rotating the rotation-support member about the vertical axis when the water supply and drain means drains water form the outer tub and the rotation-support member rotating means is connected to the rotation drive means;

the machine further comprising:

a switching means provided between the rotation drive means and the rotation-support member rotating means, wherein the switching means switches between a first condition where the rotation of the inner-tub rotating means driven by the rotation drive means is transmitted to the rotation support member rotating means so that the rotation-support member rotates at the same speed in the same direction as the inner tub and a second condition where the rotation of the inner tub rotating means is not transmitted to the rotation-support member rotating means, said switching means comprising:

a hollow drive shaft that is fixed to a rotation-support member, penetrates the bottom of the outer tub, and rotates about the vertical axis;

a rotation drive shaft that is rotatably supported in the hollow drive shaft and is driven by the motor; and a clutch mechanism for switching between the first condition in which the rotation of the rotation drive shaft by the motor is transmitted to the hollow drive shaft without changing the speed and the direction, and the second condition, in which the rotation of the rotation drive shaft is not transmitted to the hollow drive shaft.

3. A machine for washing and removing water from laundry, comprising:

an outer tub for containing water;

a water supply and drain means for supplying water to and draining water out of the outer tub;

a rotation-support member rotatably supported about a vertical axis in the outer tub;

an inner tub, having multiple pores in its periphery and being rotatably supported about a horizontal axis by the rotation-support member, for containing the laundry;

an inner-tub rotating means to rotating the inner tub;

a rotation drive ;means connected to the inner-tub rotating means for driving the inner-tub rotating means; and a rotation-support member rotating means detachably attached to the rotating drive means;

wherein:

the rotation-support member rotating means controls the rotation of the rotation support member and allows the inner tub to rotate about the horizontal axis when the rotation-support member rotating means is detached from the rotation drive means;

the rotation-support member rotating means rotates the rotation-support member and the inner tub at the same speed in the same direction about the vertical axis and controls the rotation of the inner tub relative to the rotation-support member when the rotation-support member rotating means is connected to the rotation drive means;

the machine washes and rinses the laundry by rotating the inner tub about the horizontal axis when the water supply and drain means supplies water into the outer tub so that water reaches a predetermined level inside the inner tub, the inner tub is loaded with laundry, and the rotation-support member rotating means is detached from the rotation drive means; and the machine removes water from the laundry, after washing and rinsing the laundry in the inner tub, by rotating the rotation-support member about the vertical axis when the water supply and drain means drains water from the outer tub and the rotation-support member rotating means is connected to the rotation drive means;

the machine further comprising:

a switching means provided between the rotation drive means and the rotation-support member rotating means, wherein the switching means switches between a first condition where the rotation of the inner-tub rotating means driven by the rotation drive means is transmitted to the rotation-support member rotation means so that the rotation-support member rotates at the same speed in the same direction as the inner tub and a second condition where the rotation of the inner-tub rotation means is not transmitted to the rotation-support member rotating means, the switching means comprising:

an abnormality detect means for detecting abnormal vibration of the rotation-support member during the water removing operation due to an unbalance of the laundry in the inner tub; and modification means by which the rotation-support member rotating means is disengaged from the rotation drive means when the abnormality detect means the abnormal vibration of the rotation-support member, the rotation support member is stopped, the inner tub is rotated a predetermined number of times or for a predetermined time to modify the unbalance of the laundry in the inner tub, and then the rotation-support member rotating means is connected to the rotation drive means.

4. A machine for washing and removing water from laundry, comprising:

an outer tub for containing water;

a water supply and drain means for supplying water to and draining water out of the outer tub;

a rotation-support member rotatably supported about a vertical axis in the outer tub;

an inner tub, having multiple pores in its periphery and being rotatably supported about a horizontal axis by the rotation-support member, for containing the laundry;

an inner-tub rotating means for rotating the inner tub, and a rotation drive means connected to the inner-tub rotating means for driving the inner-tub rotating means, the inner-tub rotating means comprising irreversible gears that do not transmit the rotation of the inner tub to the rotation drive means due to the force caused by fallen laundry during a washing operation and a rinsing operation; and a rotation-support member rotating means detachably attached to the rotation drive means;

wherein:

the rotation-support member rotating means controls the rotation of the rotation support member and allows the inner tub to rotate about the horizontal axis when the rotation-support member rotating means is detached form the rotation drive means;

the rotation-support member rotating means rotates the rotation-support member and the inner tub at the same speed in the same direction about the vertical axis and controls the rotation of the inner tub relative to the rotation-support member when the rotation-support member rotating means is connected to the rotation drive means;

the machine washes and rinses the laundry by rotating the inner tub about the horizontal axis when the water supply and drain means supplies water into the outer tub so that water reaches a predetermined level inside the inner tub, the inner tub is loaded with laundry, and the rotation-support member rotating means is detached form the rotation drive means; and the machine removes water from the laundry, after washing and rinsing the laundry in the inner tub, by rotating the rotation-support member about the vertical axis when the water supply and drain means drains water form the outer tub and the rotation-support member rotating means is connected to the rotation drive means.

5. A machine for washing and removing water form laundry, comprising:

an outer tub for containing water;

a water supply and drain means for supplying water to and draining water out of the outer tub;

a rotation-support member rotatably supported about a vertical axis in the outer tub, the outer tub and the rotation-support member being formed in cylinders with bottoms and the rotation support member being provided with multiple pores in its periphery;

an inner tub, having multiple pores in its periphery and being rotatably supported about a horizontal axis by the rotation-support member, for containing the laundry;

an inner-tub rotating means for rotating the inner tub;

a rotation drive means connected to the inner-tub rotating means for driving the inner-tub rotating means; and a rotation-support member rotating means detachably attached to the rotating drive means;

wherein:

the rotation-support member rotating means controls the rotation of the rotation support member and allows the inner tub to rotate about the horizontal axis when the rotation-support member rotating means is detached form the rotation drive means;

the rotation-support member rotating means rotates the rotation-support member and the inner tub at the same speed in the same direction about the vertical axis and controls the rotation of the inner tub relative to the rotation-support member when the rotation-support member rotating means is connected to the rotation drive means;

the machine washes and rinses the laundry by rotating the inner tub about the horizontal axis when the water supply and drain means supplies water into the outer tub so that water reaches a predetermined level inside the inner tub, the inner tub is loaded with laundry, and the rotation-support member rotating means is detached from the rotation drive means; and the machine removes water from the laundry, after washing and rinsing the laundry in the inner tub, by rotating the rotation-support member about the vertical axis when the water supply and drain means drains water from the outer tub and the rotation-support member rotating means is connected to the rotation drive means.

6. A machine for washing and removing water from laundry, comprising:

an outer tub for containing water;

a water supply and drain means for supplying water to and draining water out of the outer tub;

a rotation-support member rotatably supported about a vertical axis in the outer tub;

an inner tub, having multiple pores in its periphery and being rotatably supported about a horizontal axis by the rotation-support member, for containing the laundry;

an inner-tub rotating means for rotating the inner tub;

a rotation drive means connected to the inner-tub rotating means for driving the inner-tub rotating means; and a rotation-support member rotating means detachably attached to the rotating drive means;

wherein:

the rotation-support member rotating means controls the rotation of the rotation support member and allows the inner tub to rotate about the horizontal axis when the rotation-support member rotating means is detached from the rotation drive means;

the rotation-support member rotating means rotates the rotation-support member and the inner tub at the same speed in the same direction about the vertical axis and controls the rotation of the inner tub relative to the rotation-support member when the rotation-support member rotating means is connected to the rotation drive means;

the machine washes and rinses the laundry by rotating the inner tub about the horizontal axis when the water supply and drain means supplies water into the outer tub so that water reaches a predetermined level inside the inner tub, the inner tub is loaded with laundry, and the rotation-support member rotating means is detached form the rotation drive means; and the machine removes water form the laundry, after washing and rinsing ;the laundry in the inner tub, by rotating the rotation-support member about the vertical axis when the water supply and drain means drains water from the outer tub and the rotation-support member rotating means is connected to the rotation drive means;

the machine further comprising:

a cover having a first opening through which the laundry is loaded and unloaded and a first lid for opening and closing the opening;

a second opening in ;the periphery of the inner tub through which the laundry is loaded and unloaded, and a second lid provided in the inner tub for opening and closing the opening; and a positioned stop means for stopping the inner tub and the rotation-support member when the second opening of the inner tub and the first opening of the cover coincide after the laundry is washed and rinsed so that the lid may be opened.

7. A machine for washing and removing liquid from the laundry as in claim 1 in which the rotating drive means and the inner tub rotating means are constructed to wash and rinse the laundry by rotating the inner tub forward and in reverse.

8. A machine for washing and removing liquid from the laundry as in claim 1 in which the switching means is constructed so as to repeat a liquid removing process several times by detaching the rotation-support member rotating means from the rotation drive means in the course of the liquid removing process of the rotation-support member and by connected the rotation-support member rotating means to the rotation drive means after the inner tub rotates a predetermined number of times or after a predetermined time period elapses.

9. A machine for washing and removing water from the laundry as in claim 4 in which the inner-tub rotating means comprises:

a rotation drive shaft driven by the rotation drive means and rotatably supported in the outer tub;

a driven rotating shaft supported by the rotation-support member about the axis orthogonal to the surface including the axis of the rotating drive shaft at a predetermined distance with the axis and having a transmission mechanism for transmitting the rotation to the inner tub; wherein the driven rotating shaft and the rotating drive shaft are connected via skew gears.

10. A machine for washing and removing water from the laundry as in claim 9 in which the skew gears comprise a hypoid gear provided on the driven rotating shaft and a pinion provided on the rotating drive shaft for meshing with the hypoid gear.

11. A machine for washing and removing liquid from the laundry as in claim 1 in which the inner tub is formed in a substantially spherical shape.

12. A machine for washing and removing liquid from the laundry as in claim 1 in which the liquid supply and drain means comprises a liquid supply means and a liquid drain means, the liquid supply means being constructed to supply liquid to the upper outer surface of the inner tub.

13. A machine for washing and removing liquid from the laundry as in claim 12 in which the liquid supply means is constructed to supply liquid in a specified amount or for specified time at least at the beginning of the water removing operation after the washing operation.

14. A machine for washing and removing water from the laundry in claim 6 in which the positioned stop means comprises a first detected body provided on the rotation-support member and a first detect body provided in the cover or in the outer tub for detecting the first detected body so that the rotation-support member is stopped when the second opening of the inner tub and the first opening in the cover coincide in the direction of the rotation of the rotation-support member.

15. A machine for washing and removing water from laundry as in claim 14 in which the positioned stop means comprises a second detected body provided in the inner tub and a second detect body provided in the cover or in the outer tub for detecting the second detected body so that the inner tub is stopped rotating about the horizontal axis when the second opening in the inner tub and the first opening in the cover coincide.

16. A machine for washing and removing water from the laundry in claim 6 in which the positioned stop means comprises a detected body provided in the lid and a detect body provided in the cover or in the outer tub for detecting the detected body so that the inner tub is stopped at an appropriate position and the lid is properly closed.

* * * * *